US011400581B2

(12) United States Patent
Spaulding, Jr. et al.

(10) Patent No.: US 11,400,581 B2
(45) Date of Patent: Aug. 2, 2022

(54) EXTENDED LENGTH ROTATING AND REMOVABLE BIT/DRIVER RAILS

(71) Applicant: APEX BRANDS, INC., Apex, NC (US)

(72) Inventors: James Chester Spaulding, Jr., Lexington, SC (US); Stephen M. Batsa, Lexington, SC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/084,855

(22) Filed: Oct. 30, 2020

(65) Prior Publication Data

US 2021/0146525 A1 May 20, 2021

Related U.S. Application Data

(60) Provisional application No. 62/935,994, filed on Nov. 15, 2019.

(51) Int. Cl.
*B25H 3/00* (2006.01)
*B25H 3/02* (2006.01)

(52) U.S. Cl.
CPC ..... *B25H 3/003* (2013.01); *B25H 3/02* (2013.01)

(58) Field of Classification Search
CPC ..... B25H 3/003; B25H 3/025; B25H 3/00; B25H 3/006; B25H 3/02; B25H 3/021; B25H 3/023; B25B 13/56
USPC ..... 206/379, 378, 372, 349
See application file for complete search history.

(56) References Cited

U.S. PATENT DOCUMENTS

| | | | | |
|---|---|---|---|---|
| 6,213,296 | B1 | 4/2001 | Streich et al. | |
| 7,165,674 | B2 | 1/2007 | Pangerc et al. | |
| 7,255,229 | B2 | 8/2007 | Roesler | |
| 9,694,489 | B2 | 7/2017 | Steele et al. | |
| 2005/0056559 | A1* | 3/2005 | Chen | B25H 3/003 206/372 |
| 2005/0241974 | A1* | 11/2005 | Chen | B25H 3/003 206/379 |
| 2016/0052125 | A1* | 2/2016 | Steele | B25H 3/021 206/372 |
| 2021/0078159 | A1* | 3/2021 | Jiang | B65D 45/18 |

FOREIGN PATENT DOCUMENTS

| | | | |
|---|---|---|---|
| CA | 2255182 | C | 7/2003 |
| DE | 212017000158 | U1 | 2/2019 |
| EP | 2185327 | B1 | 7/2018 |

* cited by examiner

*Primary Examiner* — Rafael A Ortiz
*Assistant Examiner* — Sanjidul Islam
(74) *Attorney, Agent, or Firm* — Burr & Forman LLP

(57) ABSTRACT

A case for storing drivable components includes first and second half shells, a frame member included in the first or second half shell, a first rail having a first length and including a first plurality of receptacles configured to receive a first set of drivable components, and a second rail having a second length shorter than the first length and including a second plurality of receptacles configured to receive a second set of drivable components. The frame member includes rail holding slots. Both the first and second rail are removable from the rail holding slots and rotatable therein between a storage position and an in-use position. When in the storage position, the first rail is retained at a first bit storage layer within the case and the second rail is retained at a second bit storage layer.

18 Claims, 17 Drawing Sheets

FIG. 1.
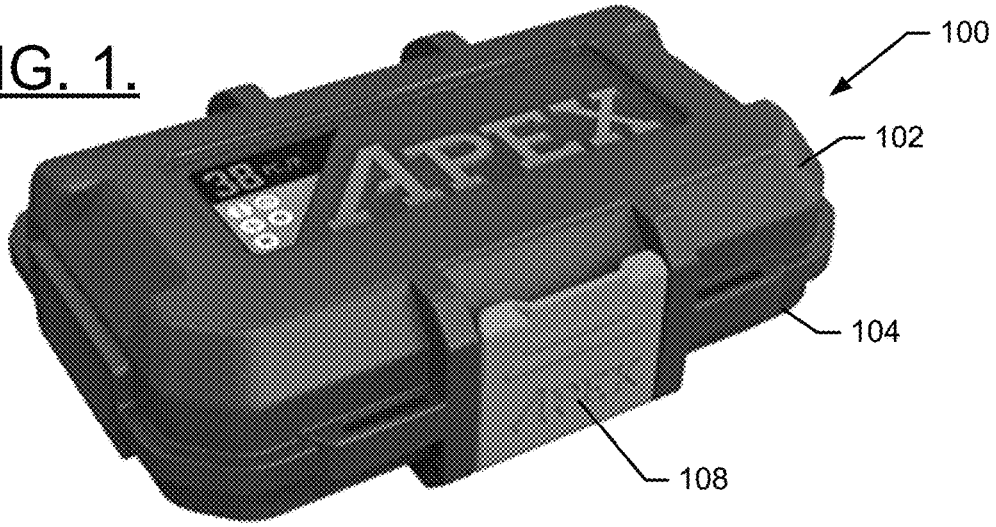
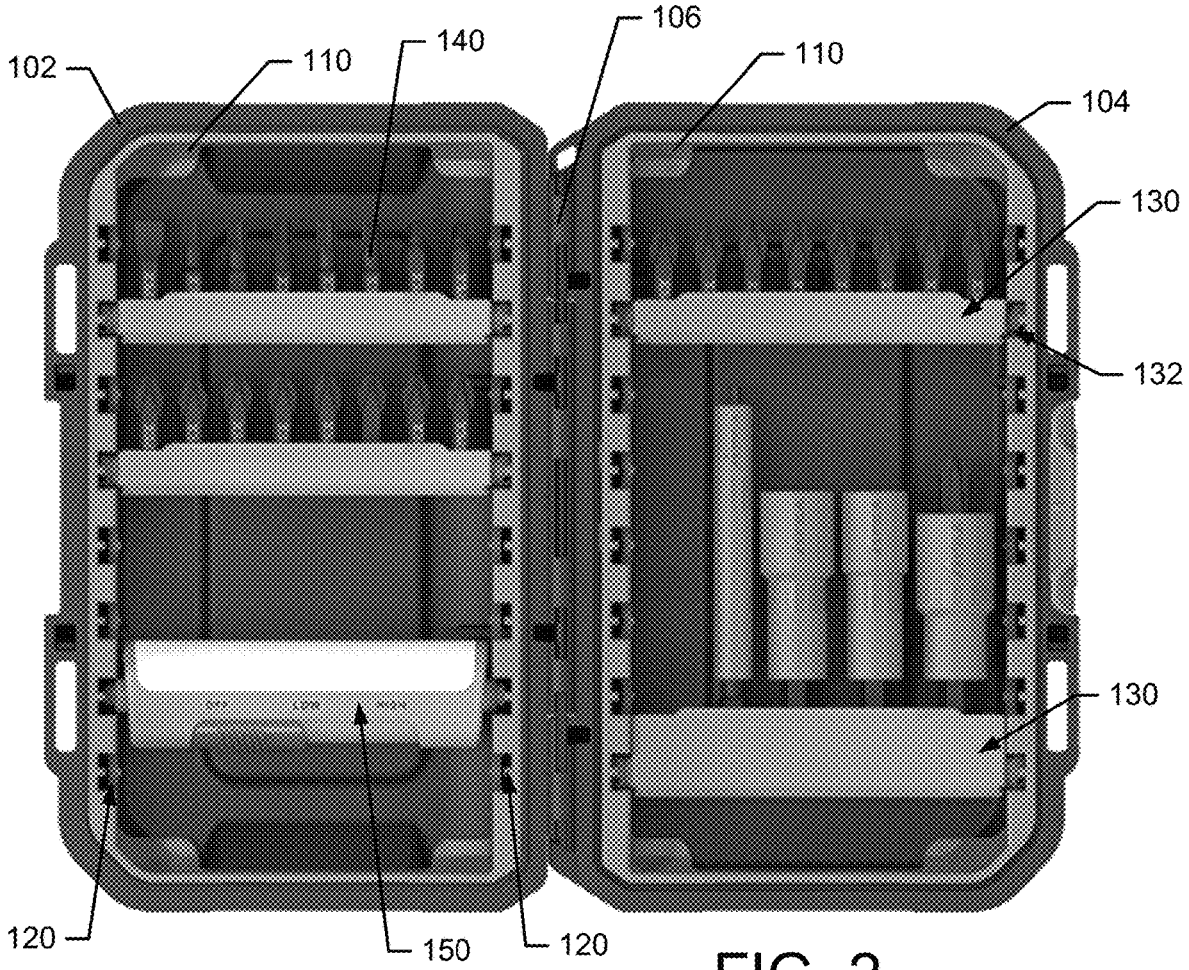
FIG. 2.

FIG. 9C.
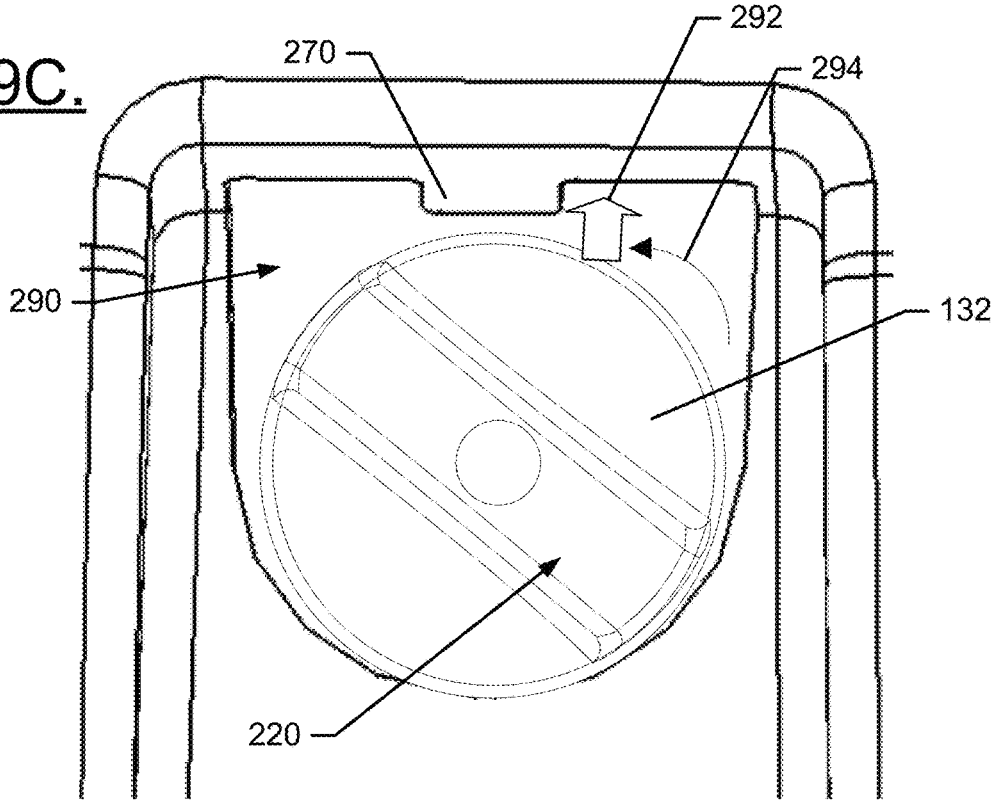
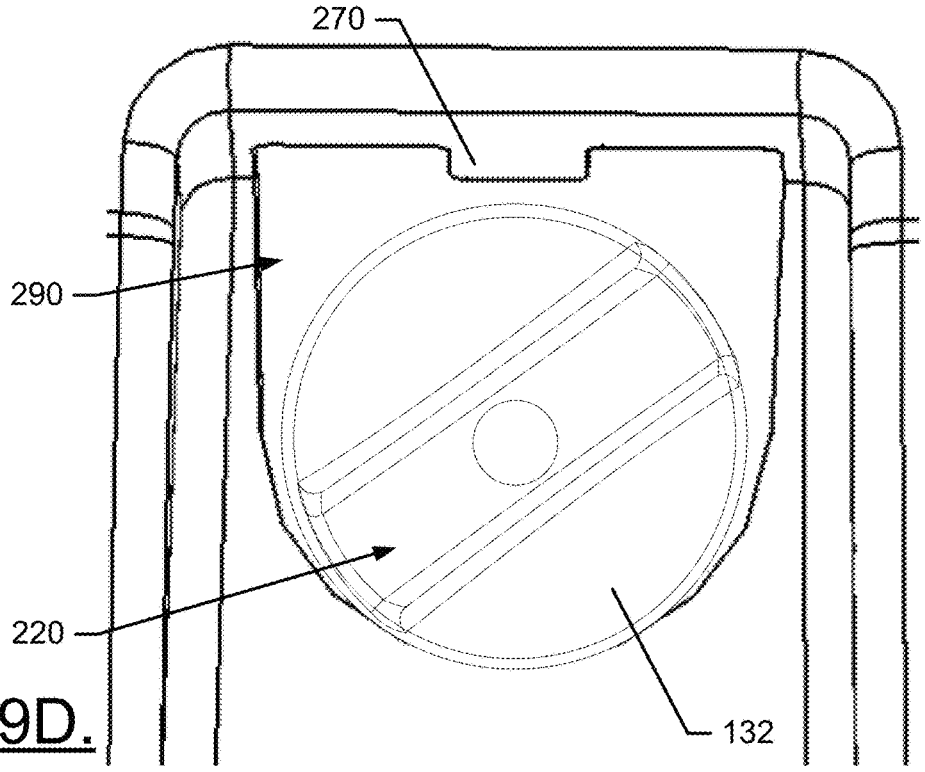
FIG. 9D.

FIG. 11.
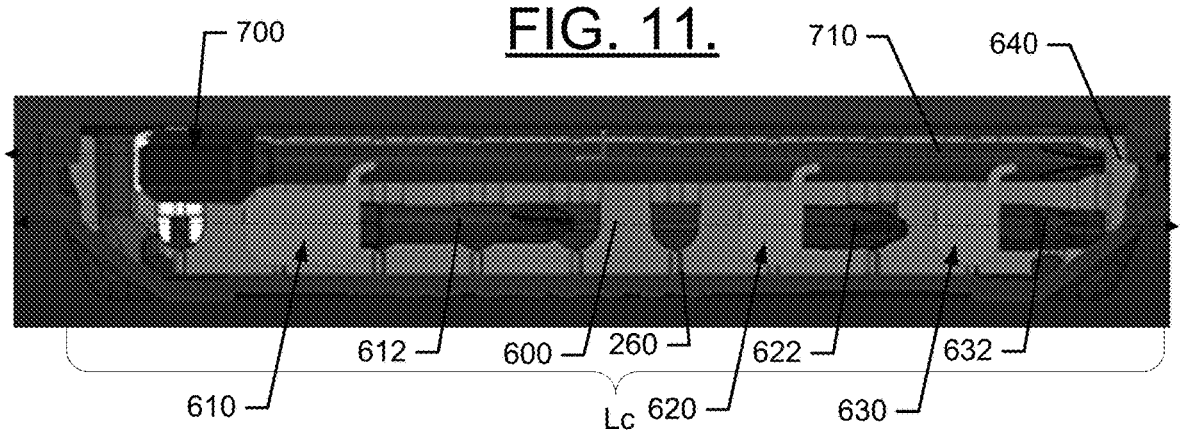
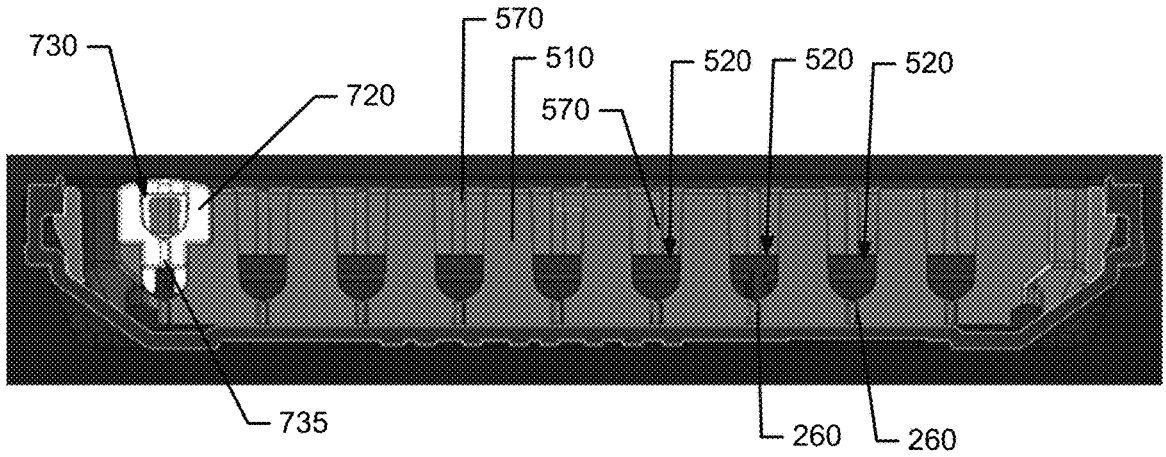
FIG. 12.

FIG. 18A.
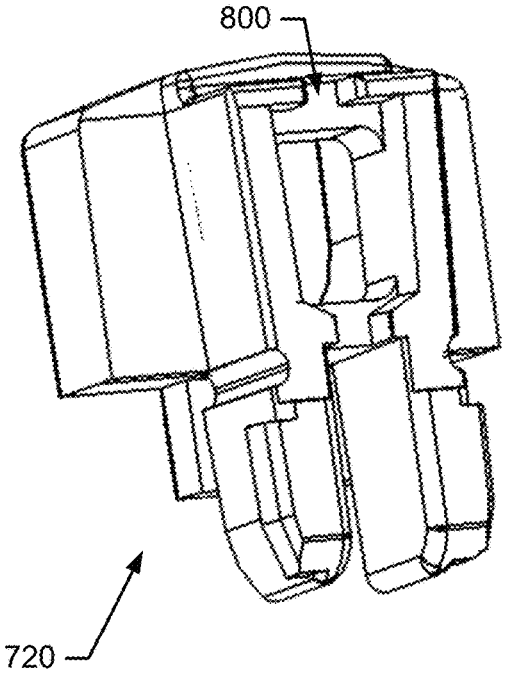
FIG. 18B.
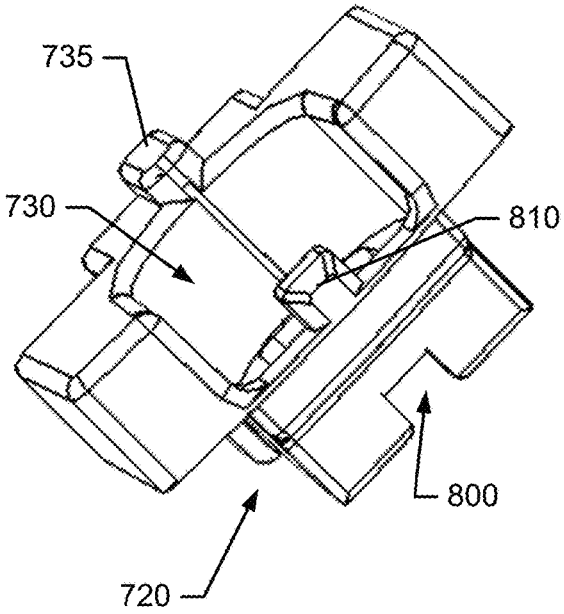
FIG. 18C.
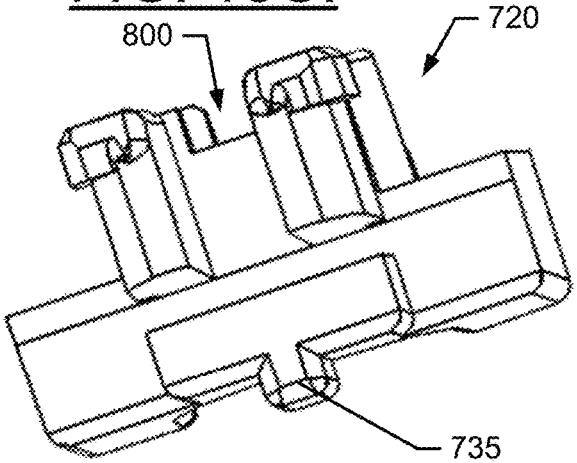
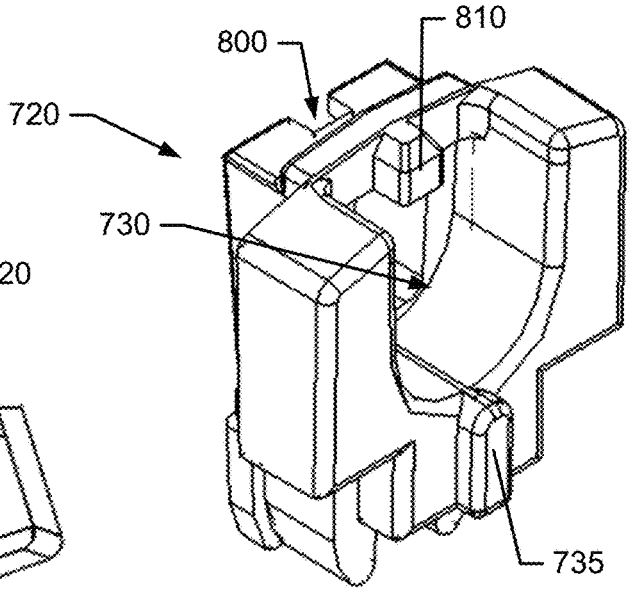
FIG. 18D.

EXTENDED LENGTH ROTATING AND REMOVABLE BIT/DRIVER RAILS

TECHNICAL FIELD

Example embodiments generally relate to hand tools and, in particular, relate to a removable and rotatable bit/driver rails for tool cases that can accommodate long bits.

BACKGROUND

Drivable components such as drill bits, drivers and/or the like, have long been sold in sets that include different shapes and sizes. These sets would typically be sold in, or otherwise be capable of storage in cases that were made large enough to handle the entire set. Before the advent of standard-sized hex shanks, the diameter of straight drill bit shanks might vary with the diameter of the bit itself. Thus, the case would have a plurality of slots, each sized to hold a corresponding diameter of drill bit when the bit was secured in its respective slot. Case structures and layouts were therefore strictly dictated by the manufacturer of the cases. Although case structures were defined for numerous combinations and numbers of bits and/or drivers, the structures tended (regardless of how complex) to be relatively inflexible in relation to any ability to rearrange the locations of bits and/or drivers within the case.

However, with hex shanks becoming common, not only can many different sizes (and types) of drill bits all have a common shank size and shape, but many different sizes and types of drivers can also share the common shank size and shape. In particular, a quarter inch hex shank is fairly standard for use with bits and drivers of all types, shapes and sizes. Thus, the same receptacle can be used to hold each and every bit and driver within a case. This may enable the user to mix and match locations of the individual bits and drivers to any desirable set of selected locations within a case that is configured to include a plurality of hex shaped receptacles.

Yet, even with the ability to have any particular drivable component fit into each and every hex-shaped receptacle, the inner structures and arrangements of storage cases have often not been flexible enough to enable users to rearrange storage paradigms. As such, users have also not typically been able to shift the storage receptacles to discrete different positions associated with use and storage while also being having full freedom to rearrange storage paradigms. This difficulty has been further exacerbated when longer bits (e.g., bits as long as about six inches) are intended to be stored in a case.

Thus, it may be desirable to provide a new design for cases and/or the bit/driver receptacles therein.

BRIEF SUMMARY OF SOME EXAMPLES

In an example embodiment, a case for storing drivable components may be provided. The case may include a first half shell and a second half shell operably coupled to each other via a hinge, a frame member included in at least one of the first half shell or the second half shell, a first rail having a first length and including a first plurality of receptacles configured to receive a first set of drivable components, and a second rail having a second length shorter than the first length and including a second plurality of receptacles configured to receive a second set of drivable components. The frame member may include rail holding slots disposed in lateral sides of the frame member. Both the first rail and the second rail may be configured to be removable from the rail holding slots and rotatable in the rail holding slots between a storage position in which the first rail or the second rail is fixed in an orientation in which the first and second sets of drivable components extend substantially parallel to a base portion forming an outer wall of the case and an in-use position in which the first rail or the second rail is rotated out of the storage position. When in the storage position, the first rail may be retained at a first bit storage layer within the case and the second rail is retained at a second bit storage layer.

In another example embodiment, a case for storing drivable components may be provided. The case may include a first half shell and a second half shell operably coupled to each other via a hinge defining a hinge axis, a frame member included in at least one of the first half shell or the second half shell and including rail holding slots disposed in lateral sides of the frame member, a first rail including a first plurality of receptacles configured to receive a first set of drivable components, and a second rail including a second plurality of receptacles configured to receive a second set of drivable components. The first rail may have a first length and be configured to pivot about a first rail axis, and the second rail may have a second length and be configured to pivot about a second rail axis that is substantially parallel to the first rail axis. Both the first rail and the second rail may be configured to be removable from the rail holding slots and rotatable in the rail holding slots between a storage position in which the first rail or the second rail is fixed in an orientation in which the first and second sets of drivable components extend substantially parallel to a base portion forming an outer wall of the case and an in-use position in which the first rail or the second rail is rotated out of the storage position. The first and second rail axes may also substantially perpendicular to the hinge axis.

In yet another example embodiment, case for storing drivable components may be provided. The case may include a frame member including rail holding slots disposed in pairs on opposing lateral sides of the frame member where each rail holding slot includes an alignment protrusion. The case may further include a plurality of first rails configured to receive and retain respective ones of the drivable components, a single second rail configured to receive and retain other respective ones of the drivable components, and an adapter assembly configured to interface with a single pair of rail holding slots to define an adapted pair of rail slots configured to interface with the second rail. The first rails may each include a first body having a first length extending between one pair of rail holding slots, and a retention boss at each opposing end of the first body. The second rail may include a second body having a second length extending between the adapted pair of rail slots, and respective instances of the retention boss at each opposing end of the second body. The retention boss may include an alignment slot formed therein. The first and second rails may be removable from or insertable into the rail holding slots and adapted rail holding slots, respectively, based on alignment of the alignment slot and the alignment protrusion.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 1 illustrates a perspective view of a drivable component case according to an example embodiment;

FIG. 2 illustrates top view of the case of FIG. 1 in an opened state according to an example embodiment;

FIG. 9C is a side view of the boss being retained within the rail holding slot and locked in an in-use position according to an example embodiment;

FIG. 9D is a side view of the boss being retained within the rail holding slot and locked in a storage position according to an example embodiment;

FIG. 11 illustrates a lengthwise cross sectional view of the case with short and long rails installed therein and rotated to the storage position in accordance with an example embodiment;

FIG. 12 illustrates a lengthwise cross sectional view of the case without long rails in accordance with an example embodiment;

Figure 19:
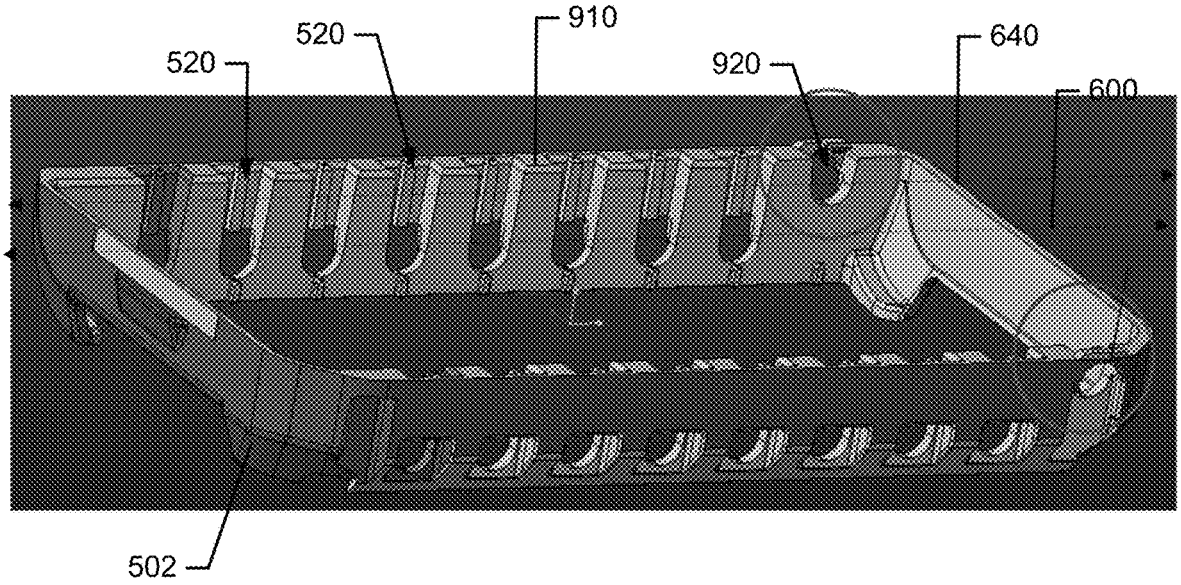

FIG. 18, which is defined by FIGS. 18A, 18B, 18C and 18D, illustrates various perspective views of one adapter insert of the adapter assembly in isolation in accordance with an example embodiment; and FIG. 19 illustrates a perspective view of an alternative design where the second bit storage layer is achieved without use of an adapter in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of a fully reconfigurable drivable component case that can accommodate bits having a long length. The frame inside the case may be configured for receiving one or more rails that have a series of drivable component receptacles provided therein. The rails may each be removable from the frame, but also be rotatable to various fixable positions when operably coupled to the frame. The frame may be structured to hold bits in at least two storage layers. In this regard, a first layer may be used to store long bits (i.e., bits that have a length greater than 50% of the length of the case/frame (and in some cases as much as 90% of the length of the case/frame), and the second layer may be used to store shorter bits (bits less than 50% of the length of the case/frame). The first layer may be the top layer (i.e., the layer that must be opened first in order to enable access to the second layer) in order to ensure that all bits are accessible without removing any one of the rails and instead simply by rotating the rail of the top layer out of the way so that rails of the bottom layer can all also be rotated.

The creation of a layered structure with removable and reconfigurable rails may maximize the ability of users to configure the case and the bits therein into desirable configurations that meet the users' needs. The general structure of the case, the frame and the rails for just a single layer will first be described in reference to FIGS. 1-9 so that the individual features employed in each layer can be best understood. Thereafter, in reference to FIGS. 10-18, the provision of the second layer will be described in detail.

FIG. 1 illustrates a perspective view of a drivable component case 100 according to an example embodiment, and FIG. 2 illustrates the case opened up so that inner portions thereof are visible. As can be appreciated from FIGS. 1 and 2, the case 100 may include a first half shell 102 and a second half shell 104 that may be hingedly attached to each other. The first and second half shells 102 and 104 may each include a base portion (i.e., forming a top wall and a rear wall, respectively) and four sidewalls that each extend perpendicularly away from the base portion (and substantially perpendicular to adjacent ones of the sidewalls) to define a container portion in each respective one of the first and second half shells 102 and 104. When the first and second half shells 102 and 104 rotate about hinge 106 toward each other, respective ones of the sidewalls of the first half shell 102 meet and align with the sidewalls of the second half shell 104 at distal edges thereof. Meanwhile, the base portions of each of the first and second half shells 102 and 104 will lie in parallel planes that are spaced apart from each other by the height of the case 100. A locking mechanism 108 may be provided at sidewalls opposite the hinge 106 to enable the case to be locked in the closed position.

The container portion of each of the first and second half shells 102 and 104 may be configured to include a frame member 110 (or simply "frame"). The frame members 110 of each of the first and second half shells 102 and 104 may be configured to snap fit or otherwise be affixed inside the container portion of their respective one of the first and second half shells 102 and 104. However, in some cases, the frame member 110 of each of the first and second half shells 102 and 104 may be an integral portion of the first and second half shells 102 and 104, respectively. In an example embodiment, the frame members 110 may be configured to engage or otherwise be a portion of the sidewalls of the first and second half shells 102 and 104, and may extend from the base portion along the sidewalls to be flush with distal ends of the sidewalls. When formed separately (i.e., not integrally formed), an outer periphery of the frame members 110 may lie adjacent to an inner periphery defined by the sidewalls of the first and second half shells 102 and 104. Meanwhile, an inner periphery of each of the frame members 110 may be formed to include a plurality of rail holding slots 120. In this regard, an equal number of rail holding slots 120 may be positioned on each opposing lateral side of the frame members 110 to correspond to each other. In other words, the rail holding slots 120 may be disposed in pairs on opposing lateral sides of each of the frame members 110. In the example of FIG. 2, the pairs of rail holding slots 120 may each be equidistant from each adjacent pair of rail holding slots 120. However, it should be appreciated that spacing between adjacent pairs of rail holding slots 120 need not be spaced equidistantly, and instead, any desired spacing therebetween could be employed. Moreover, although the pairs of rail holding slots 120 mirror each other in each of the instances of the frame members 110, such mirroring also does not necessarily need to be employed in alternative embodiments. When formed integrally in the sidewalls, the rail holding slots 120 may effectively be formed in the same manner described above except that due to the integral formation of the frame members 110 in the sidewalls of the first and second half shells 102 and 104, the rail holding slots 120 may be equally considered to be formed in the sidewalls as in the first and second half shells 102 and 104 as in the frame members 110.

As shown in FIG. 2, a plurality of rails 130 may be stored within the case 100. More particularly, one instance of the rails 130 may be inserted into a corresponding pair of rail holding slots 120. The rails 130 may include retention bosses 132 at opposing longitudinal ends of the rails 130. The retention bosses 132 may be configured to interface with the rail holding slots 120 to allow each of the rails 130 to be both removable and rotatable relative to the rail holding slots 120. As will be discussed below, the rails 130 may be rotated to multiple different positions (e.g., one position during insertion and two positions after insertion) in which the rails 130 may be fixed relative to their respective frame member 110. However, at least one of the multiple different positions may be a storage position, which is shown in FIG. 2. In the storage position, bits or drivers (e.g., drivable components 140) that are inserted into the rails 130 and retained therein may lie such that a longitudinal centerline or axis thereof is substantially parallel to the plane of the base portion of the case 100.

In an example embodiment, the drivable components 140 may include bits, sockets, drive heads, etc., of various shapes, sizes and/or types. In this example, each of the drivable components 140 may include a hex shaft (e.g., a quarter-inch hex shaft). Thus, spacing between the rails 130 may be selected such that when the rails 130 are retained in the storage position, a distance between adjacent rails 130 is at least longer than a length of any one of the drivable components 140 retained in one of the adjacent rails 130. However, it should be appreciated that, in some example embodiments, other accessories (e.g., light bar 150) may also be retained by the frame members 110. In this regard, for example, such accessories may also include instances of the retention bosses 132 to interface with a selected pair of the rail holding slots 120 to allow retention, removal and rotation of the accessories in similar fashion to the performance of the same functions relative to the rails 130.

Figure 3A:
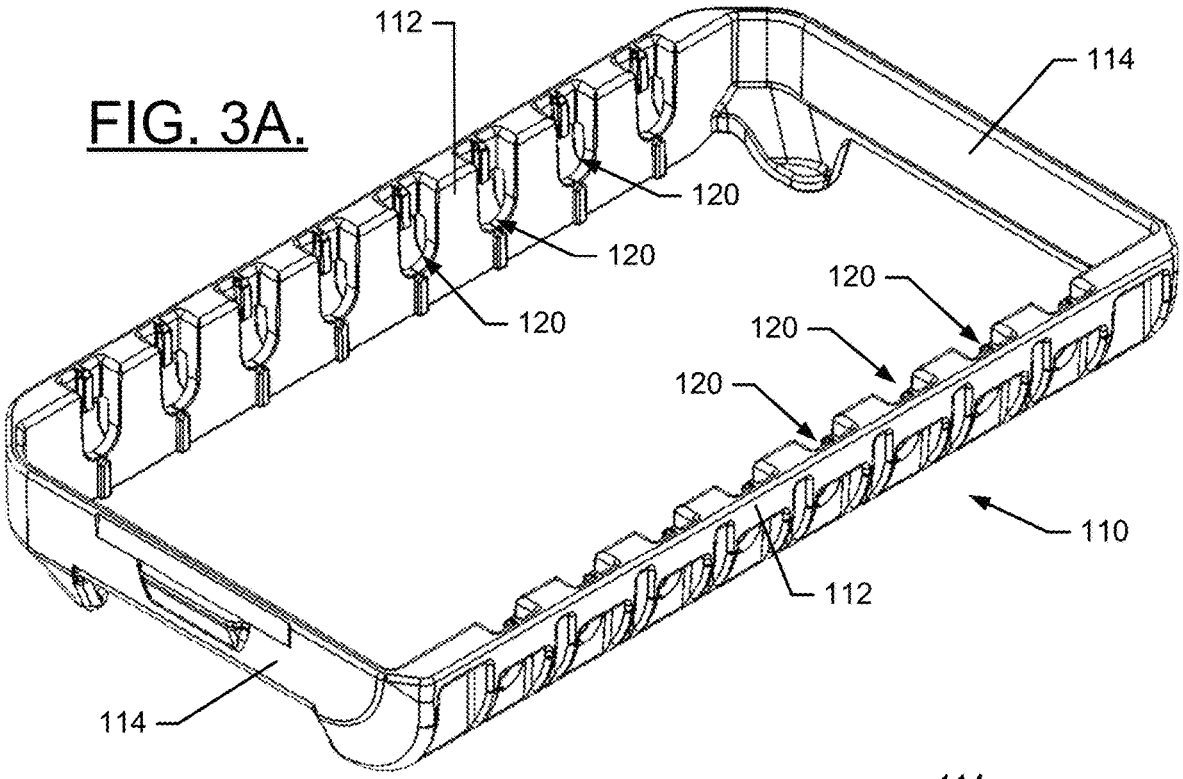
FIG. 3A illustrates a top perspective view of a frame of the case according to an example embodiment.
Figure 3B:
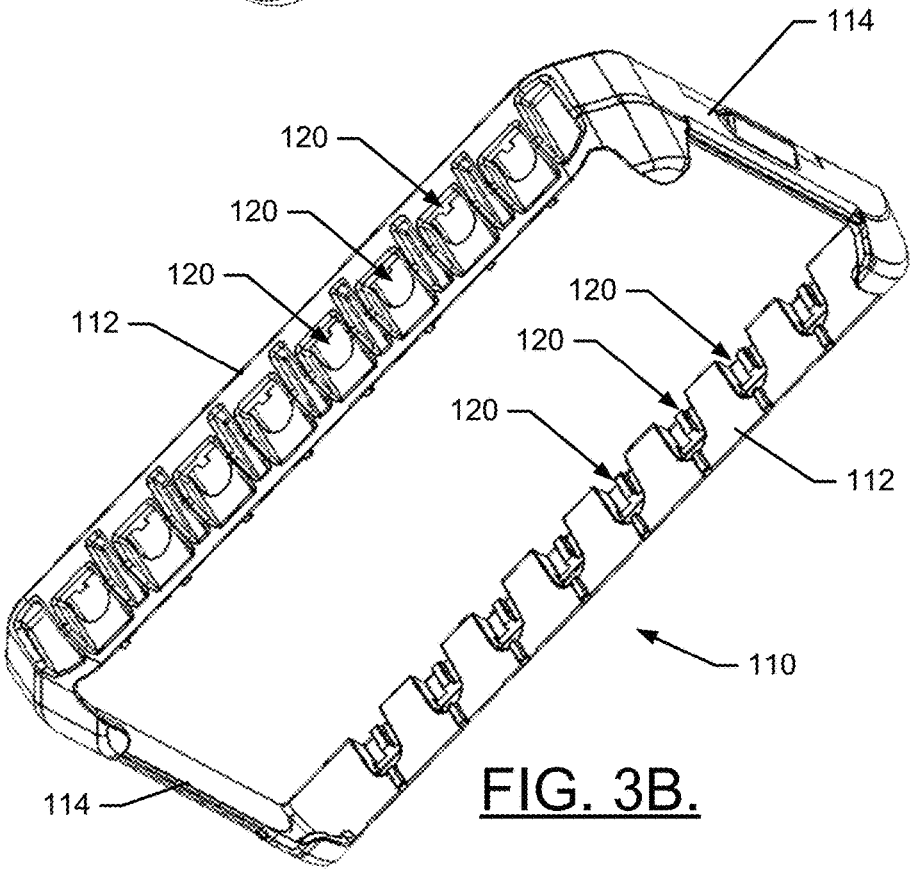
FIG. 3B illustrates a bottom perspective view of the frame of the case according to an example embodiment.
Figure 4A:
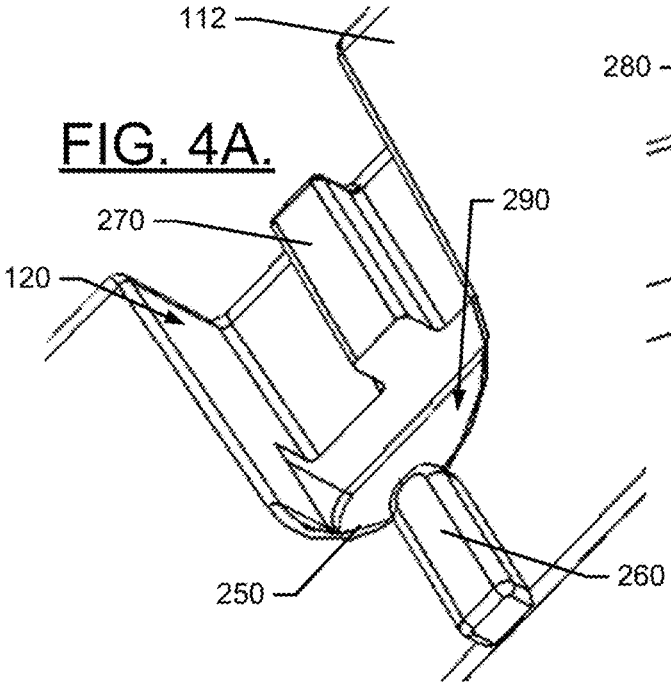
FIG. 4A illustrates a perspective view of a rail holding slot from inside the frame (looking out) according to an example embodiment.
Figure 4B:
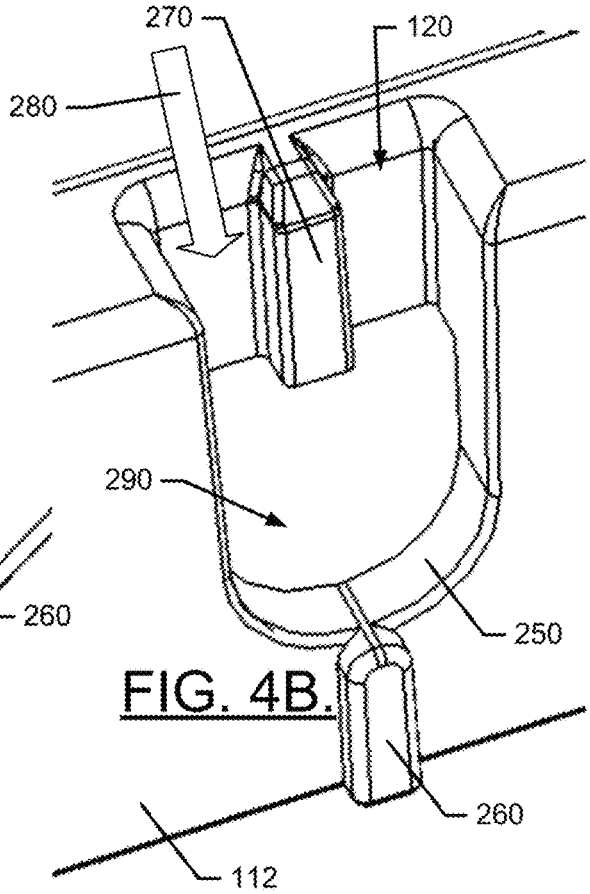
FIG. 4B illustrates an alternative perspective view of the rail holding slot from inside the frame according to an example embodiment.
Figure 4C:
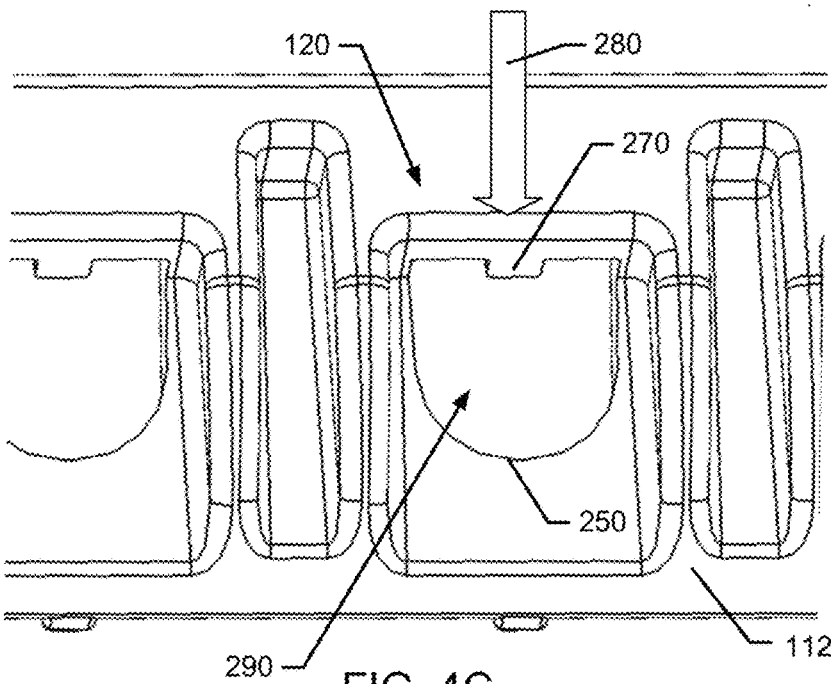
FIG. 4C illustrates a perspective view of a rail holding slot from outside of the frame (looking in) according to an example embodiment.
Figure 5A:
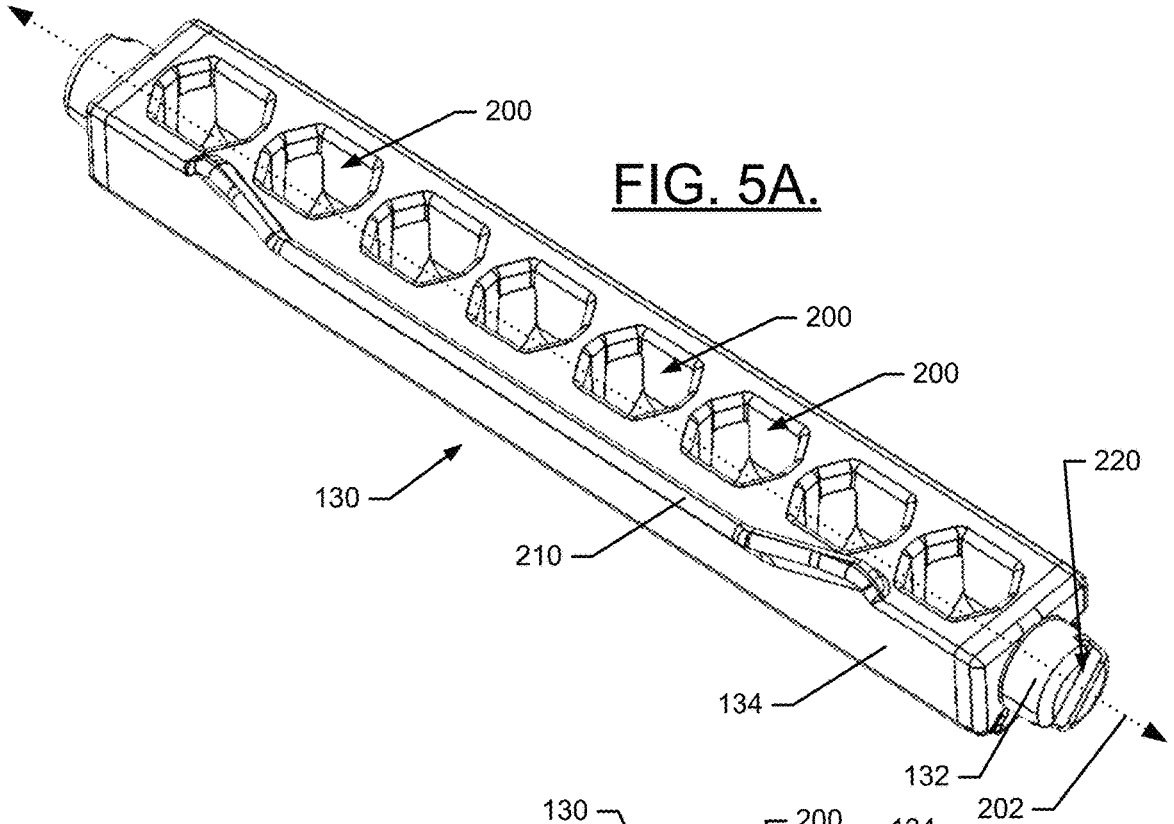
FIG. 5A is a top perspective view of a rotatable and removable rail that interfaces with the rail holding slot of the frame according to an example embodiment.
Figure 5B:
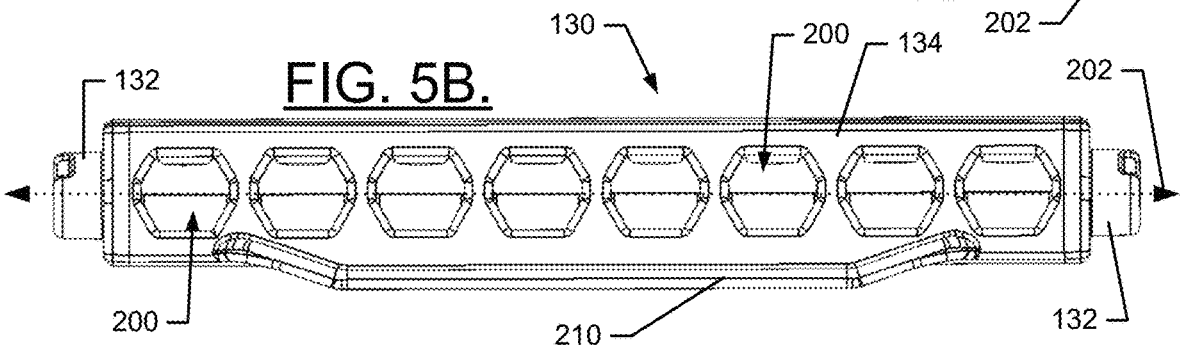
FIG. 5B illustrates a top view of the rotatable and removable rail of FIG. 5A according to an example embodiment.
Figure 5C:
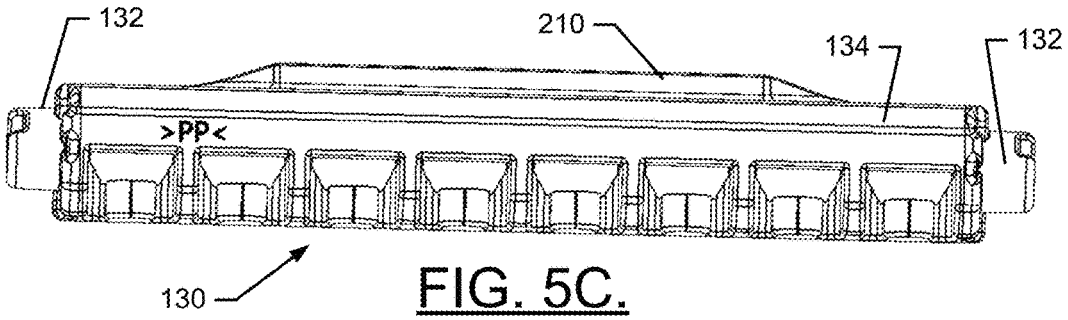
FIG. 5C illustrates a bottom view of the rotatable and removable rail of FIG. 5A according to an example embodiment.
Figure 5D:
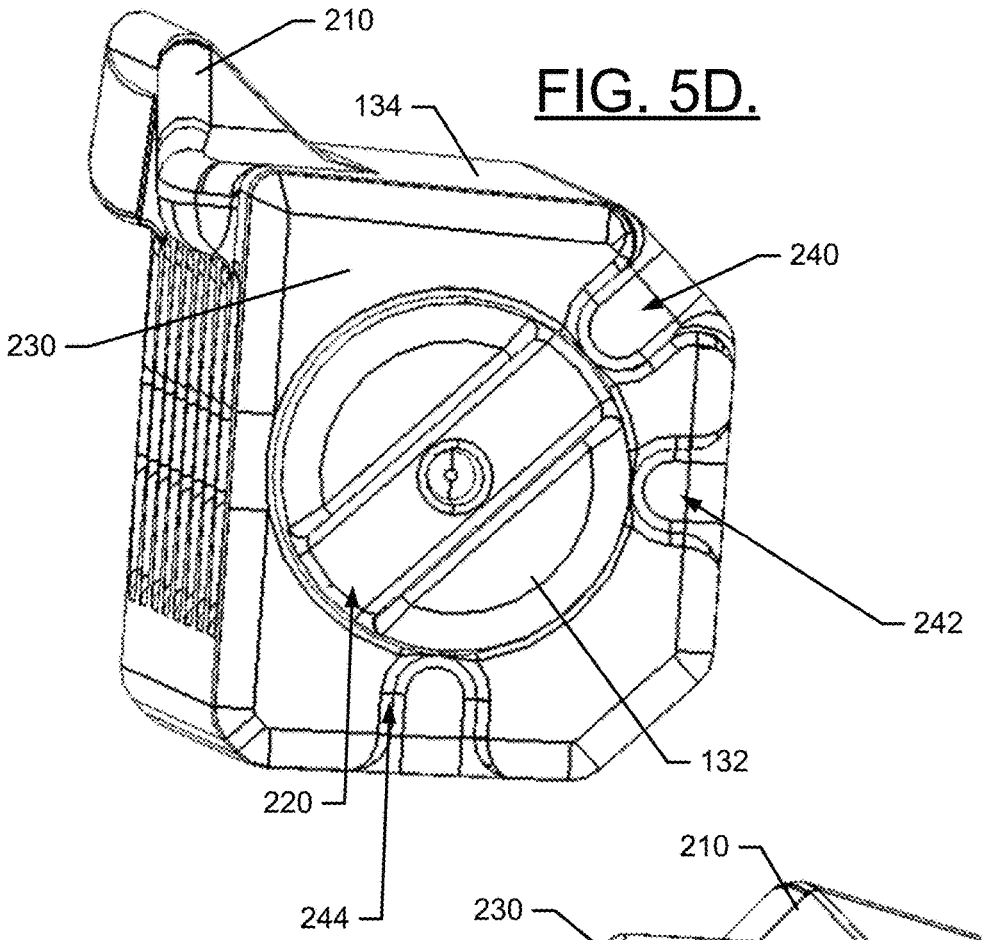
FIG. 5D illustrates a side perspective view of the rotatable and removable rail of FIG. 5A according to an example embodiment.
Figure 5E:
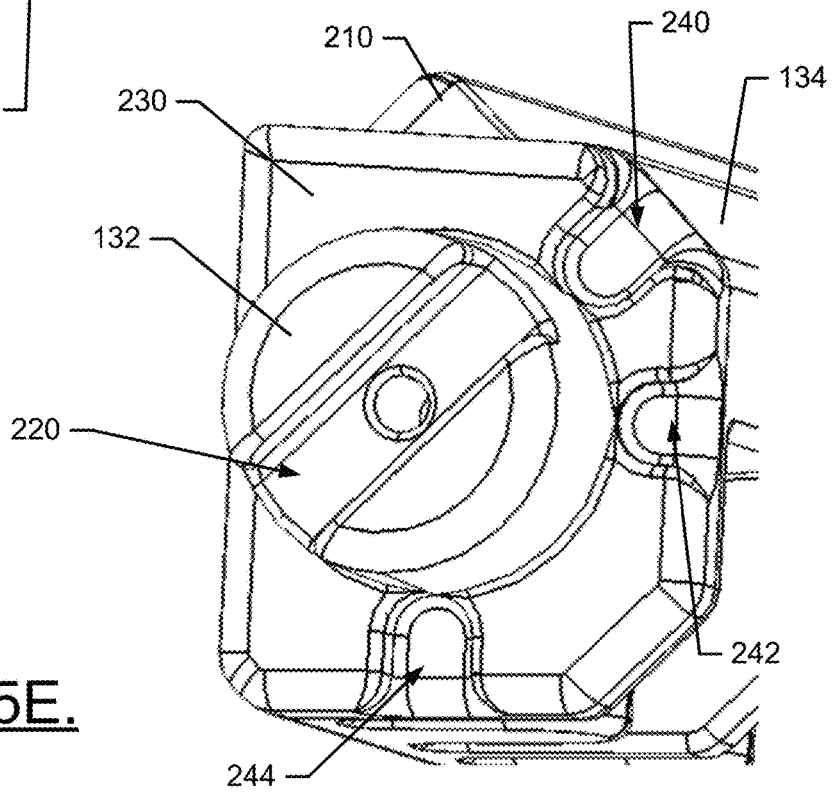
FIG. 5E illustrates another side perspective view of the rotatable and removable rail of FIG. 5A according to an example embodiment.
Figure 6:
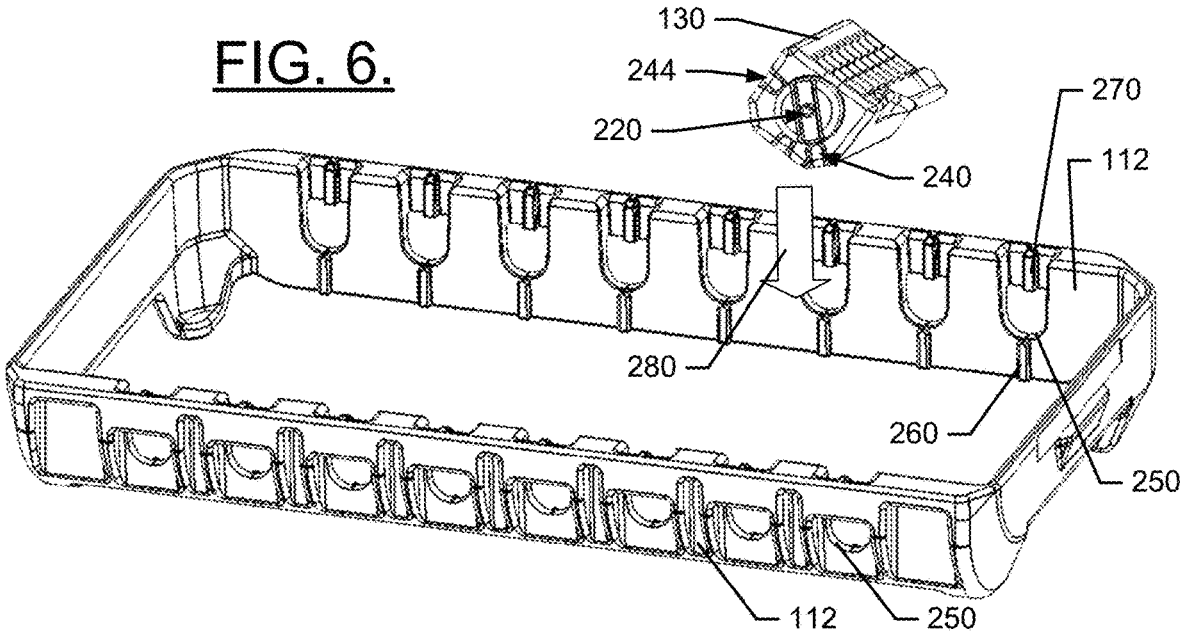
FIG. 6 is a perspective view of one instance of the rotatable and removable rail being aligned for installation into the frame according to an example embodiment.
Figure 7:
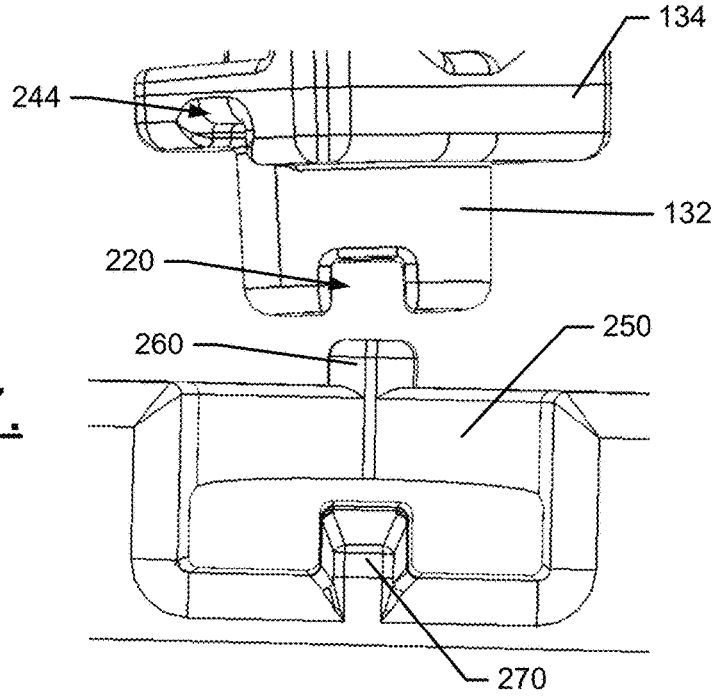
FIG. 7 illustrates a top view of a slot in a boss of the rotatable and removable rail being aligned with an alignment protrusion of the rail holding slot according to an example embodiment.
Figure 8:
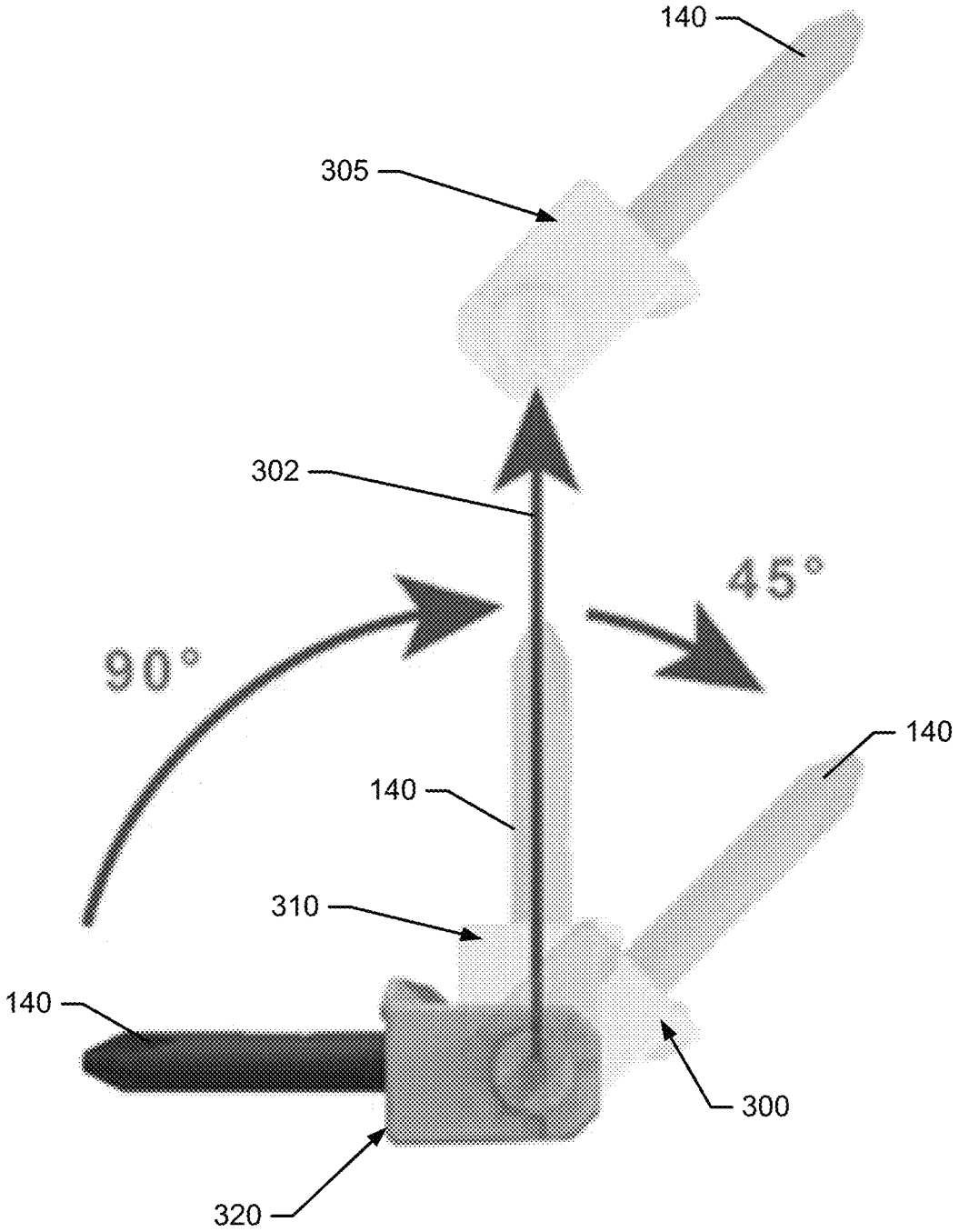
FIG. 8 is a side view showing three installed positions of the rotatable and removable rail according to an example embodiment.

FIGS. 3A and 3B illustrate top and bottom perspective views of one instance of the frame member 110 of the case 100 of FIGS. 1 and 2. FIGS. 4A, 4B and 4C illustrate various views of one instance of the rail holding slot 120 to facilitate a discussion of the same. FIGS. 5A, 5B, 5C, 5D and 5E illustrate various views of one instance of the rail 130 described above in reference to FIGS. 1 and 2. FIGS. 6 and 7 show the rail 130 being aligned for installation into the frame member 110 according to an example embodiment. FIG. 8 shows three fixable positions for the rail 130 based on alignment (or non-alignment) of the retention bosses 132 with alignment features of the rail holding slots 120. FIG. 9 may then be used to describe these alignment or non-alignment conditions in greater detail.

Referring primarily to FIG. 3, which is defined by FIGS. 3A and 3B, the frame member 110 may include lateral sides 112 and transverse sides 114 that are arranged to form a substantially rectangular shape. In this regard, the transverse sides 114 extend parallel to each other between respective ends of the lateral sides 112. The rail holding slots 120 are formed in the lateral sides 114 in pairs that mirror each other in position and structure. In particular, the rail holding slots 120 are formed at least in part by an absence (or removal) of material from the lateral sides 112 to form structures that interface with the rails 130 (and particularly with the retention bosses 132) to enable the rails 130 to be removable from and rotatable within the rail holding slots 120 as described in greater detail below.

As shown best in FIG. 5, which is defined by FIGS. 5A-5E, each instance of the rail 130 may include a plurality of receptacles 200 formed in a body 134 of the rail 130. The receptacles 200 may be substantially hex shaped, and may be configured to retain a quarter-inch hex shaft responsive to insertion of the quarter-inch hex shaft therein. The receptacles 200 may be disposed in a sequential array that is substantially in alignment with a longitudinal centerline or axis 202 of the rail 130 at a top portion of the rail 130. Although eight receptacles 200 are shown in this example, any suitable number may be included in various example embodiments based on the size of the case 100. Each of the receptacles 200 may extend substantially perpendicular to the axis 202 of the rail 130 so that, for example, an axis of each respective one of the driving components 140 that is inserted into the receptacles 200 is perpendicular to the axis 202 of the rail 130 as well. A lip portion 210 may be defined at a top portion of the rail 130 to enable an operator to grasp the lip portion 210 with a finger and rotate the rail 130. The rail 130 may rotate about the axis 202 when inserted into the rail holding slots 120 and not subjected to a force sufficient to cause it to rotate. As mentioned above, the retention bosses 132 may be disposed at opposing longitudinal ends of the rail 130. The axis 202 of the rail 130 may be aligned with an axis of the retention bosses 132.

Each of the retention bosses 132 may include an alignment slot 220 that extends through and forms a groove in a distal end of the retention boss 132. In this regard, the alignment slot 220 may extend substantially perpendicular to the axis 202. As best seen in FIGS. 5D and 5E, the retention boss 132 of each longitudinal end of the rail 130 may extend outwardly away from an end face 230 of the rail 130. The end face 230 may lie in a plane that is substantially perpendicular to the axis 202. The alignment slot 220 may therefore extend in a direction that is parallel to the plane of the end face 230. However, the alignment slot 220 may be spaced apart from the end face 230 due to the extension of the retention boss 132 away from the body 134 of the rail 130.

In an example embodiment, a plurality of locking slots may be formed in the end face 230. Each of the locking slots may have a predetermined orientation relative to the alignment slot 220 and each other. In this regard, a first locking slot 240 may extend radially inwardly from a peripheral edge of the end face 230 toward the axis 202. The first locking slot 240 may be substantially aligned with the alignment slot 220. A second locking slot 242 may be offset from the first locking slot 240 by about 45 degrees. The second locking slot 242 may therefore be substantially aligned with an axis of the driving components 140 when inserted into the receptacles 200 (and therefore the direction of insertion of driving components 140 into the receptacles 200). Thus, as can be appreciated from the description above, the alignment slot 220 may extend across the distal end of the retention boss 132 in a direction that is offset from the direction of insertion of driving components 140 into the receptacles 200 by about 45 degrees. The second locking slot 242 may also extend radially inwardly from a peripheral edge of the end face 230 toward the axis 202.

Meanwhile, a third locking slot 244 may be disposed in the end face 230 to extend radially inwardly from a peripheral edge of the end face 230 toward the axis 202. The second locking slot 242 may be offset from the first locking slot 240 by about 135 degrees and offset from the second locking slot 242 by about 90 degrees. The third locking slot 244 may therefore be substantially perpendicular to the axis of the driving components 140 when inserted into the receptacles 200 (and therefore the direction of insertion of driving components 140 into the receptacles 200).

Each opposing end face 230 may include a corresponding set of the first, second, and third locking slots 240, 242 and 244 that mirror each other. Similarly, each opposing end of the rail 130 may include a retention boss 132 having its own respective instance of the alignment slot 220 formed therein. The retention bosses 132 and alignment slots 220 formed therein may also mirror each other.

Referring primarily to FIG. 4, which is defined by FIGS. 4A-4C, the structural features of the rail holding slots 120 will be described in greater detail. In this regard, the frame member 110 may have a width that is about equal to the length of the rails 130. The rail holding slots 120 may be formed in the lateral sides 112 of the frame member 110 to allow the rail 130 (particularly the retention bosses 132 thereof) to be inserted therein such that a portion of the rail holding slot 120 is closer to the same portion of its respective pair rail holding slot 120 in the frame 110 than the length of the rail 130, while another portion of the rail holding slot 120 is farther from the same portion of its respective pair rail holding slot 120 on the other side of the frame 110 so that the retention bosses 132 fit therebetween. In particular, the rail holding slot 120 may include a collar portion 250 that is spaced apart from the collar portion 250 of the opposing rail holding slot 120 on the other side of the frame member 110 by a distance slightly larger than a length of the body 134 of the rail 130. The collar portion 250 may have a depth that is about equal to a length of the rails 130 from end to end of the retention bosses 132 so that all or nearly all of the retention boss 132 on each opposing end of the rail 130 may rest on the collar portion 250 of its corresponding lateral side 112 when the rail 130 is inserted into the rail holding slots 120. The collar portion 250 may form an arcuate shape having a radius slightly larger than a radius of the retention boss 132. Thus, the retention boss 132 may be supportable on the collar portion 250, but may also be rotatable relative to the collar portion 250 when sufficient force is applied to the retention boss 132 to move it out of a particular position.

Locking of the retention boss 132 may be accomplished using a locking protrusion 260 disposed adjacent to the collar portion 250. In this regard, the locking protrusion 260 may protrude toward a center of the frame member 110 from an inner portion of the lateral side 112 next to each respective collar portion 250. A longitudinal length of the locking protrusion 260 may extend substantially perpendicular to a direction of longitudinal extension of the lateral side 112, and may terminate at or proximate to an apex of the collar portion 250. The locking protrusion 260 may have a width and depth that is substantially similar to a width and depth of the first, second and third locking slots 240, 242 and 244. As will be described in greater detail below, the lock protrusion 260 may be aligned with and inserted into a respective one of the first, second and third locking slots 240, 242 and 244 in order to lock the rail 130 at a particular orientation within the case 100.

Each instance of the rail holding slot 120 may also include an alignment protrusion 270 that extends in a direction parallel to the direction of extension of the locking protrusion 260. The alignment protrusion 270 may have a width and depth (and perhaps also length) that is substantially similar to a width and depth (and length) of the alignment slot 220. The length of the rails 130 from end to end of the retention bosses 132 may be such that the rail 130 cannot be inserted into the rail holding slot 120 unless the alignment protrusion 270 is aligned with the alignment slot 220. However, when the alignments slots 220 on each of the retention bosses 132 are aligned with each other, the rail 130 may be slid downward (in the direction of arrow 280) until the retention bosses 132 clear the bottom of the alignment protrusion 270 entirely and the retention bosses 132 are disposed in a receiving orifice 290 formed between the collar portion 250 and the alignment protrusion 270. The receiving orifice 290 may be larger than a diameter of the retention boss 132 to allow the retention boss 132 to be rotatable therein, whether or not the locking protrusion 260 is engaged with one of the first, second and third locking slots 240, 242 and 244.

Accordingly, as shown in FIGS. 6 and 7, the rail 130 may be positioned above the frame member 110 so that the alignment slot 220 is substantially aligned with the alignment protrusion 270 for each rail holding slot 120 of a given pair. Simultaneously, the rail 130 may be lowered in the direction of arrow 280 so that the alignment protrusion 270 of each of the rail holding slots 120 passes through the alignment slot 220 of each respective retention boss 132. When the alignment protrusion 270 is no longer in contact with the alignment slot 220 and the retention bosses 132 are each located in the receiving orifice 290, the rail 130 can be rotated about the axis 202 within the receiving orifices 290 on respective ends of the rail 130. One of the first, second and third locking slots 240, 242 and 244 may then be aligned with and inserted into the locking protrusion 260 to prevent further rotation of the rail 130 and lock the rail 130 in place. In particular, the first locking slot 240 may be aligned already with the locking protrusion 260 when the alignment protrusion 270 and alignment slot 220 are already aligned. However, once the retention bosses 132 are located in the receiving orifices 290, the retention bosses 132 can be rotated to align and lock in either of the other two lockable positions. Of note, when referring to the locking of the retention bosses 132, it should be appreciated that the term locking could be synonymous with retention (i.e., still being capable of movement with sufficient force) in some cases. Thus, the retention bosses 132 may be considered locked when they will not move unless a rotational force sufficient to overcome the friction or holding forces of the structures retaining the retention bosses 132 are overcome.

Figure 9A:
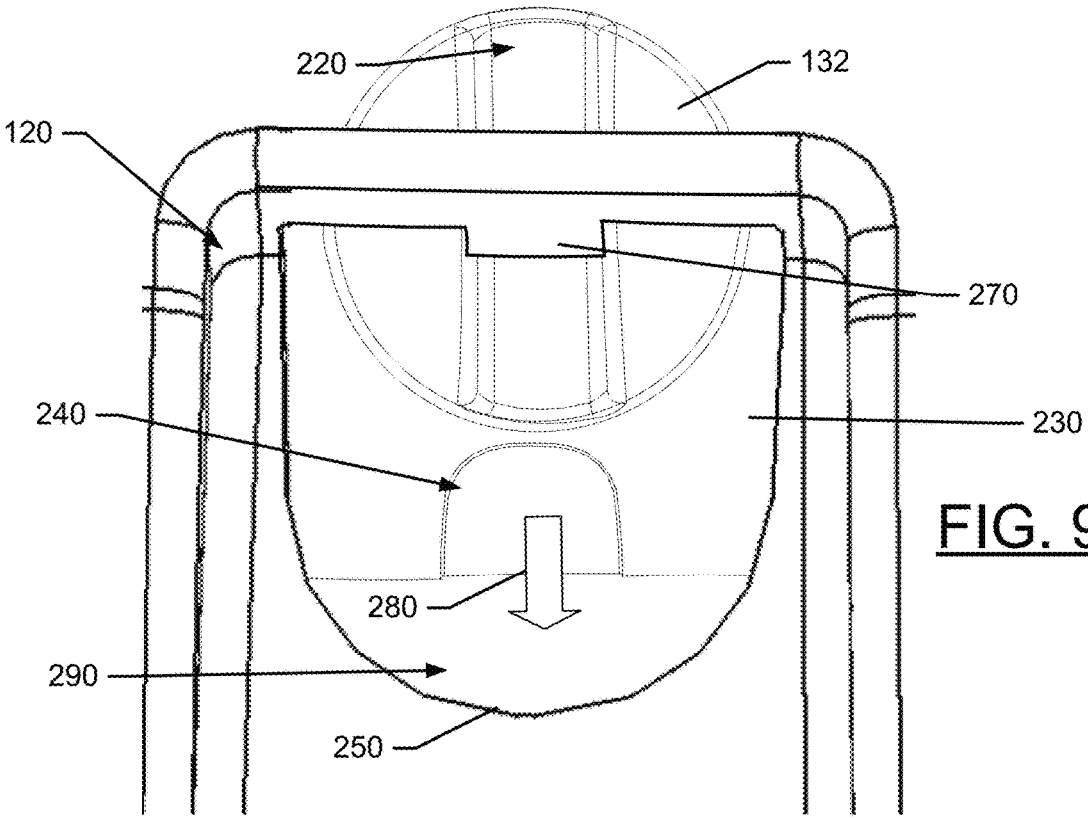
FIG. 9A is a side view of the boss being inserted into the rail holding slot according to an example embodiment.
Figure 9B:
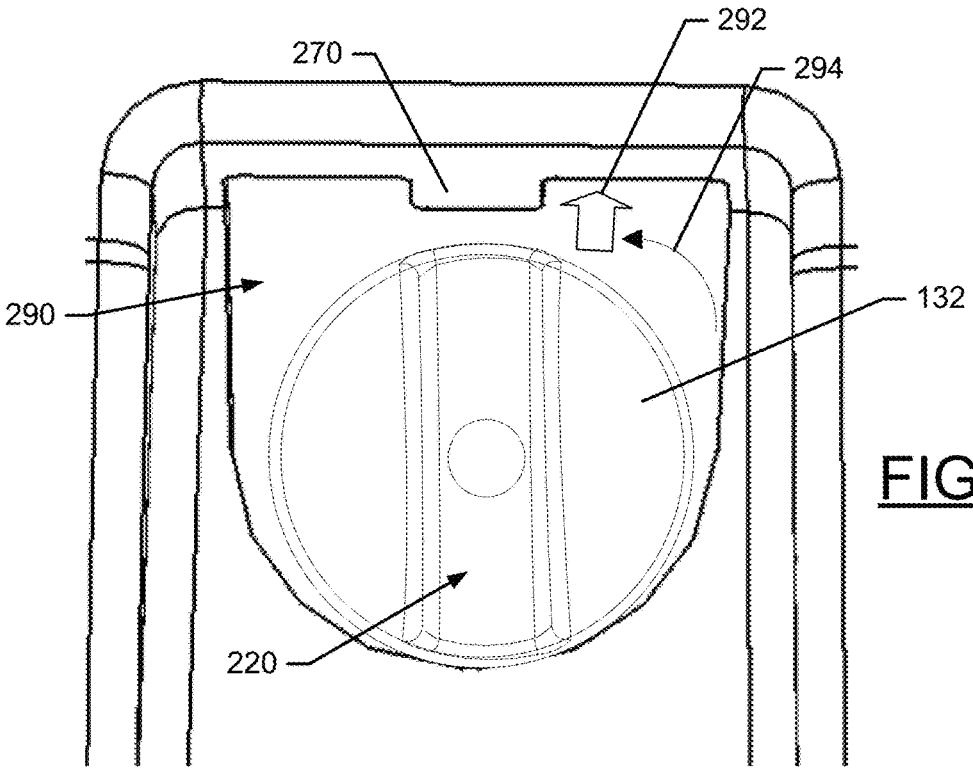
FIG. 9B is a side view of the boss within the rail holding slot in alignment for installation or removal according to an example embodiment.

FIG. 8 and FIG. 9, which is defined by FIGS. 9A, 9B, 9C and 9D, show side views of the rail 130 and the retention boss 132 of one side of the rail 130 in each of the three lockable positions. In this regard, FIG. 9A shows the retention boss 132 being inserted into the rail holding slot 120 (i.e., moved downward in the direction of arrow 280) until the rail 130 is locked in place via engagement of the first locking slot 240 and the locking protrusion 260 as shown in FIG. 9B. The position shown in FIG. 9B correlates to the install/remove position 300 shown in FIG. 8. In the install/remove position 300, the driven component 140 extends substantially at a 45 degree angle relative to the base portion of the case 100. The rail 130 can then be removed as shown by arrow 302 to the removed position 305 shown in FIG. 8.

From the position shown in FIG. 9B, the retention boss 132 may be withdrawn in the direction of arrow 292 far enough to withdraw the locking protrusion 260 from the first locking slot 240. Then the retention boss 132 may be rotated in the direction of arrow 294 to achieve alignment between the locking protrusion 260 and the second locking slot 242. However, in some cases, the frame member 110 may be sized such that the retention boss 132 consumes all of the space between the collar portion 250 and the locking protrusion 270. In such examples, the frame member 110 may be resilient enough to flex to allow the locking protrusion 260 to flex outwardly and permit the locking protrusion 260 to exit the first locking slot 270 and slide over the base portion 230 rotating in the direction of arrow 294 to the second locking slot 242. The locking protrusion 260 may be seated within the second locking slot 242 and the position shown in FIG. 9C may be achieved. The position shown in FIG. 9C correlates to the use position 310 shown in FIG. 8. In the use position 310 of FIG. 8, the driven component 140 extends substantially perpendicularly away from the base portion of the case 100.

As shown in FIG. 9C, the retention boss 132 may be withdrawn in the direction of arrow 292 far enough to withdraw the locking protrusion 260 from the second locking slot 242 (or slid out of the second locking slot 242 due to flexing of the frame member 110 as described above). Then the retention boss 132 may be rotated in the direction of arrow 294 to achieve alignment between the locking protrusion 260 and the third locking slot 244. The locking protrusion 260 may be seated within the third locking slot 244 and the position shown in FIG. 9D may be achieved. The position shown in FIG. 9D correlates to the storage position 320 shown in FIG. 8. In the storage position 320 of FIG. 8, the driven component 140 extends substantially parallel to the base portion of the case 100.

When the retention boss 132 is in the positions shown in FIGS. 9B, 9C and 9D, the retention boss 132 may be considered to be in a locked (or fixed) state. In this regard, rotation of the retention boss 132 within the receiving orifice 290 may not be possible (or at least be inhibited until enough force is exerted to cause the frame member 110 to flex to release the locking protrusion 260 from one of the locking slots) in the locked state. However, when the retention boss 132 is not locked relative to the collar portion 250, but still located in the receiving orifice 290, the retention boss 132 may be considered to be in a rotatable state. In this regard, the retention boss 132 (and therefore the rail 130) may be rotated relative to the frame member 110 and the rail holding slots 132. In some cases, the rotation may enable the retention boss 132 to be rotated to a different one of the potential fixed positions in which the retention boss 132 can be locked or otherwise retained (e.g., associated with the first, second and third locking slots 240, 242 and 244). Moreover, at any time during which the alignment slot 220 and the alignment protrusion 270 are not in alignment, the alignment protrusion 270 may prevent withdrawal of the retention boss 132 from the rail holding slots 120.

As mentioned above, FIGS. 1-9 indicate the basic structures for a case that can employ removable rails. The structures of the drivable component case 100 (including the first and second half shells 102 and 104 and the structures of the frame members 110, etc.) can be duplicated (with minor or in some cases no modification to the case) for an example that employs two separate bit storage layers. In general, to the extent a modification is made to the case 100 in order to accommodate employing two separate bit storage layers, the accommodation may include little more than extending a depth of the frame members 110 into the respective first and second half shells 102 and 104. This may slightly extend the lengths of the rail holding slots 120 and the alignment protrusion 270, but generally would not change the shape or length of the locking protrusion 260 and/or the receiving orifices 290. Moreover, in some cases, no changes may need to be made to the structures of FIGS. 1-9 above at all. Instead, an adapter assembly may be added to enable a top bit storage layer to be provided over a bottom bit storage layer.

Figure 10:
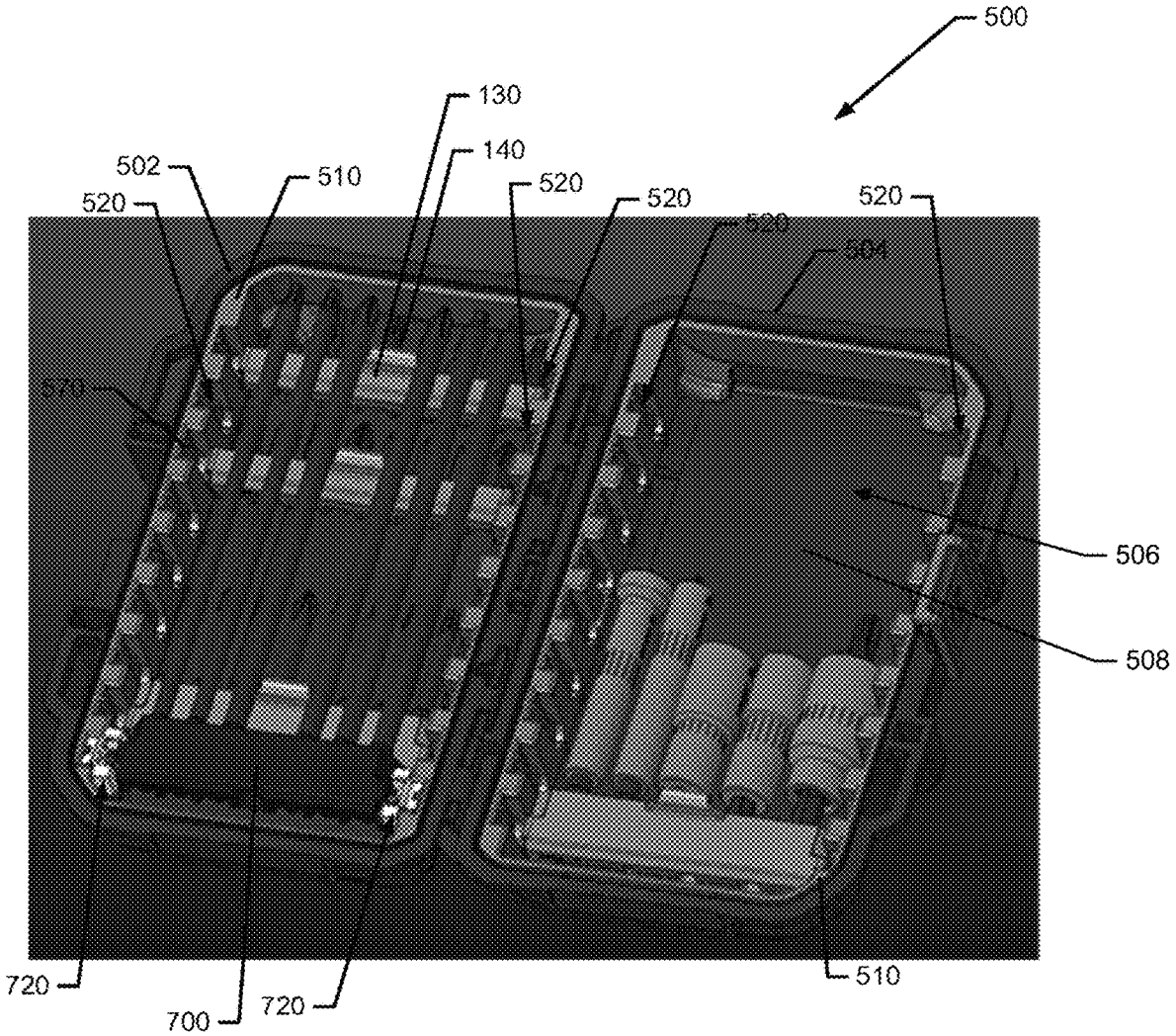
FIG. 10 illustrates top view of a case that includes bit storage layers in an opened state according to an example embodiment.
Figure 13:
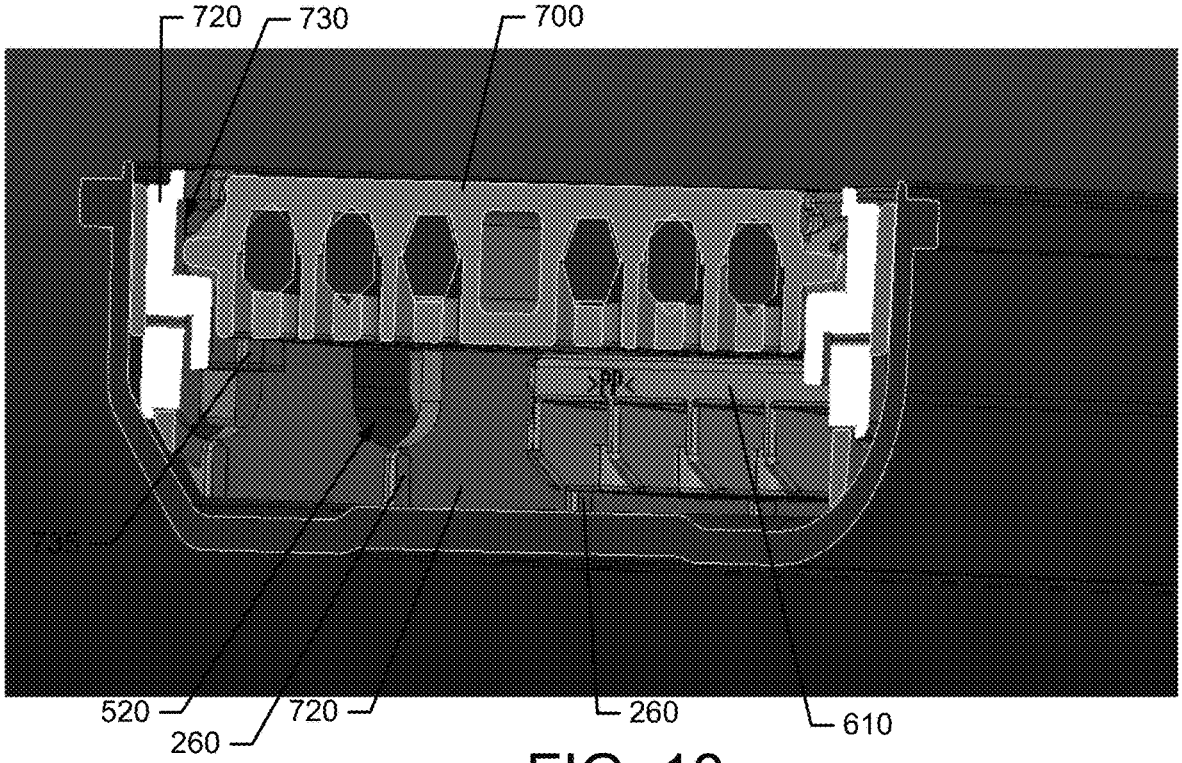
FIG. 13 illustrates a transverse cross sectional view of the case that also sections one of the short rails in accordance with an example embodiment.
Figure 14:
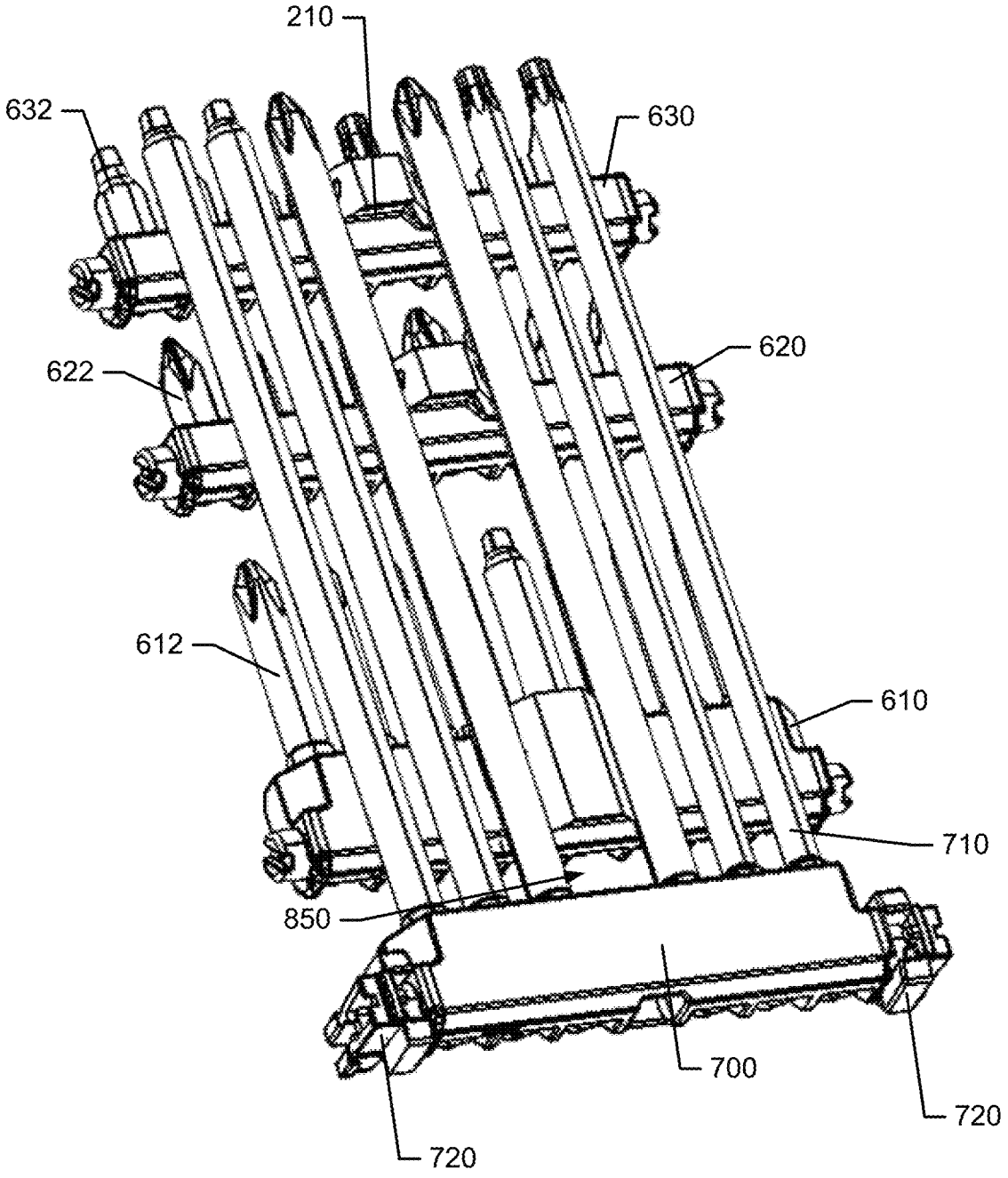
FIG. 14 illustrates the rails (both long and short, and both retaining bits) in isolation to show the first and second bit storage layers in accordance with an example embodiment.
Figure 15:
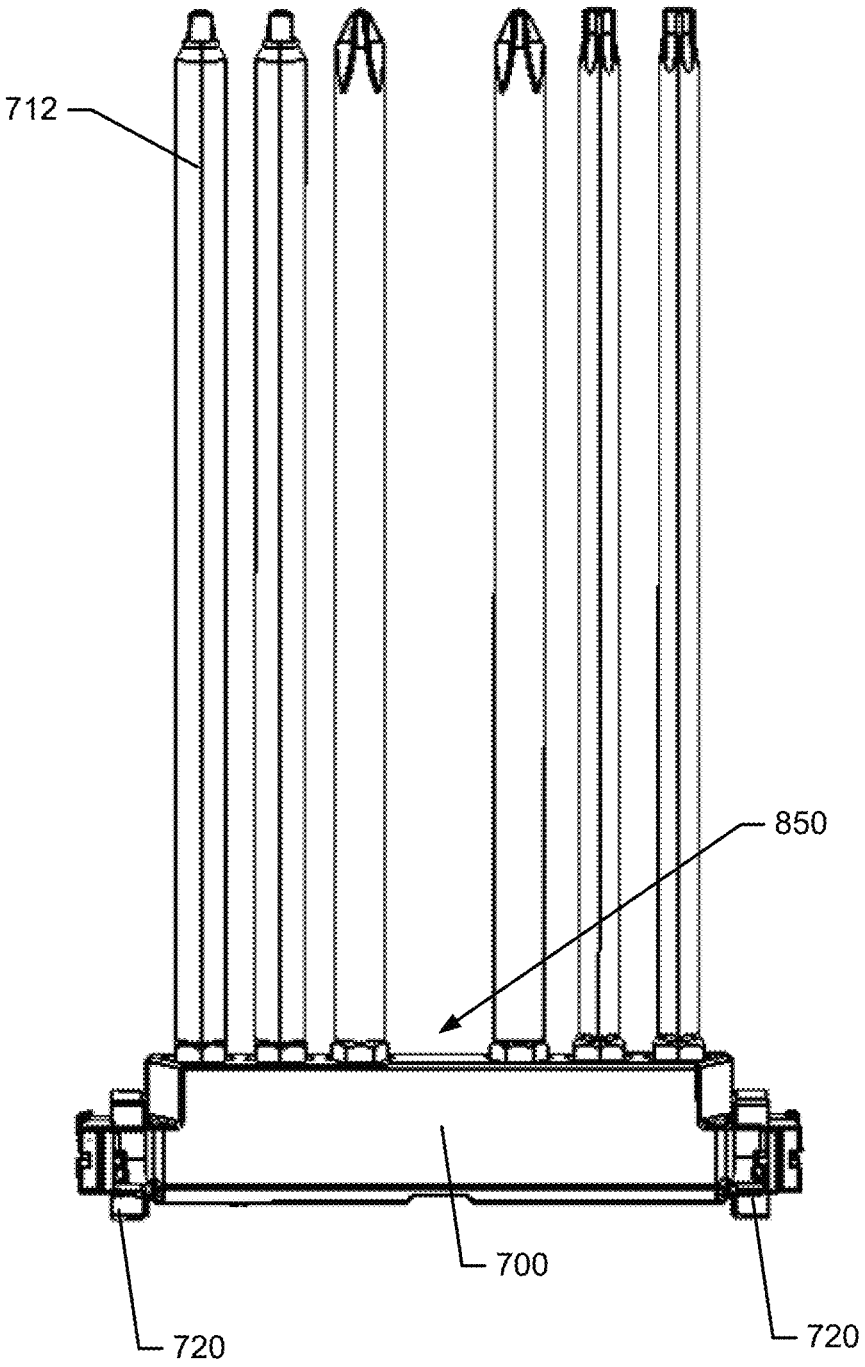
FIG. 15 illustrates a front view of just a short rail and adapter assembly in isolation while retaining bits in accordance with an example embodiment.
Figure 16:
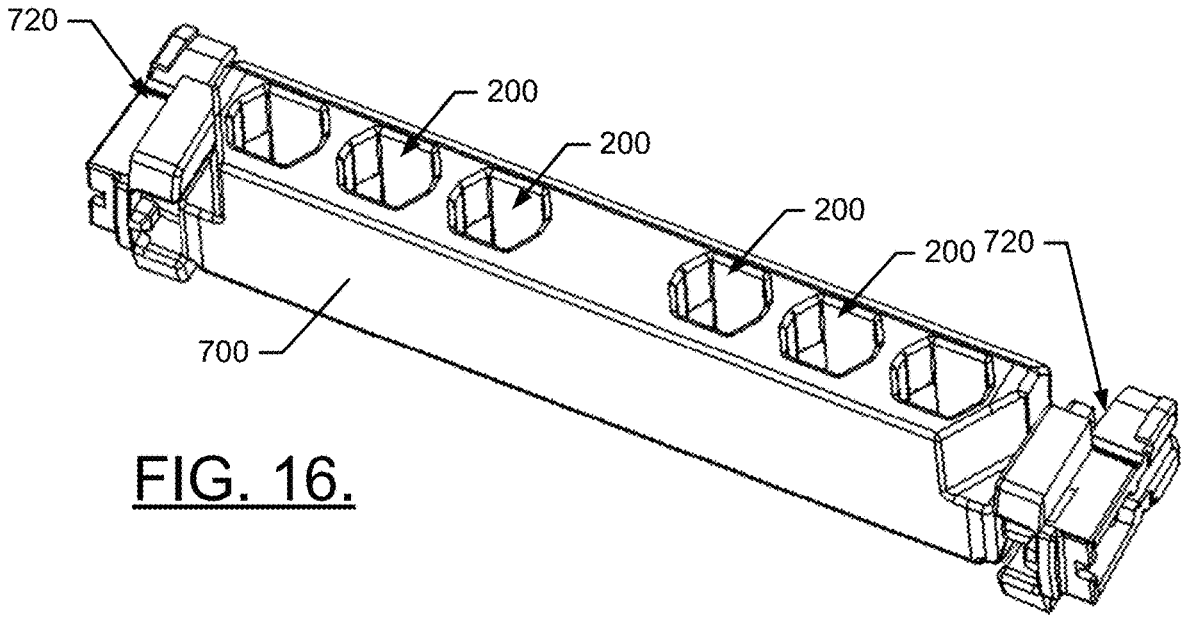
FIG. 16 illustrates a perspective view of the short rail and adapter assembly in isolation without bits in accordance with an example embodiment.

FIG. 10 illustrates a perspective view of a case 500 opened up so that inner portions thereof are visible. FIGS. 11-18 illustrate various other views of the case 500 and components thereof. As can be appreciated from the examples of FIGS. 10-18, the case 500 may be substantially the same as the case 100 except that (as noted above) the case 500 may have deeper rail holding slots 520 and a longer alignment protrusion 570 than the corresponding components (with reference numerals 120 and 270) described above. Thus, first half shell 502 and a second half shell 504 of the case 500 may also be similarly formed, attached and operated as described above except that the first and second half shells 502 and 504 may also be modified slightly to accommodate the longer rail holding slots 520 and alignment protrusions 570. The locking protrusions 260 may be essentially the same in both embodiments.

The container portion of each of the first and second half shells 502 and 504 may be configured to include a frame member 510 similar to the frame member 110 described above in terms of structure and configuration. Thus, an inner periphery of each of the frame members 510 may be formed to include a plurality of rail holding slots 520. As discussed above, the rail holding slots 520 may be disposed in pairs on opposing lateral sides of each of the frame members 510. Each rail holding slot 520 may be the same distance from its respective paired rail holding slot 520. In some cases, the frame member 510 may be a separate component from the first or second half shells 502 or 504, and may be operably coupled thereto. However, the frame member 510 of each of the first and second half shells 502 and 504 may alternatively be an integral portion of the first and second half shells 502 and 504, respectively. Thus, in embodiments where the frame member 510 is an integral portion of the first and second half shells 502 and 504, the rail holding slots 520 may be molded directly into the first or second half shells 502 or 504. In such an example, the portion of the first and second half shells 502 and 504 that includes the rail holding slots 520 molded therein may be considered to be the frame member 510.

As shown in FIG. 10, the same rails 130 described above may be stored within the case 500. More particularly, a plurality of instances of the rails 130 may be inserted into respective pairs of rail holding slots 520. The rails 130 may be rotated to multiple different positions as described above. In this regard, the rails 130 may have all of the components described above, and may interface with components of the rail holding slots 520 and the frame 510 that are also similar to the corresponding components described above. The main difference between the examples of FIGS. 1-9 and the examples of FIGS. 10-18 is that the examples of FIGS. 10-18 can employ at least two layers of rails in the storage position. However, in order to support the two layers, the second layer will have rails that are slightly shorter than the rails 130. The structures of the rails in the second layer and the adaptor used to support them will be described in greater detail below.

As mentioned above, in the storage position, the rails 130 may retain the drivable components 140 to lie such that a longitudinal centerline or axis of the drivable components 140 is substantially parallel to the plane of the base portion of the case 500. As shown in FIGS. 10 and 11, multiple instances of the rails 130 (represented by first rail 610, second rail 620 and third rail 630) may all be placed in the case 500 in the same plane (i.e., a first storage plane 600). The first storage plane 600 may also lie substantially parallel to the plane formed by the base portion of the case 500.

In this regard, for example, the first rail 610 may be inserted into a first pair of rail holding slots 520 and can be folded into the storage position so that the bits 612 retained therein lie in the first storage plane 600. The second rail 620 may also be inserted into a second pair of rail holding slots 520 and can be folded into the storage position so that the bits 622 retained therein lie in the first storage plane 600. The third rail 630 may also be inserted into a third pair of rail holding slots 520 and can be folded into the storage position so that the bits 632 retained therein also lie in the first storage plane 600. The length of the bits 612 and 622 in the first and second rails 610 and 620 may be about the same. However, the bits 632 retained in the third rail 630 may be a longer set of bits than the bits 612 and 622. That said, all of the bits 612, 622 and 632 may have a length that is less than 50% of a length (Lc) of the case 500.

In this example, the bits 612, 622 and 632 and the corresponding first, second and third rails 610, 620 and 630 that all lie in the first storage plane 600 may define a first bit storage layer. The first bit storage layer may exist at a deeper level within the case 500 (and within the rail holding slots 520) than a second bit storage layer that may lie above the first bit storage layer at a second storage plane 640. The first and second storage planes 600 and 640 are at different elevations that can be measured from a reference plane that is coexistent with an outer wall of the case 500 (and its corresponding half shell), or from an alternative reference plane that may exist at the open side of the corresponding half shell. For example, each half shell may define an opening 506 and a corresponding planar surface 508 coexistent with the opening 506. The planar surface 508 corresponding with the opening 506 of each half shell could therefore also form a reference plane alternative to the outside surface of the case 500 itself. The first bit storage layer may include a plurality of instances of the rails 130 described above. In some embodiments only modified rails 700 may be configured to fit in the second bit storage layer. In this regard, as noted above spacing between the rails 130 in the first bit storage layer may be selected such that when the rails 130 are retained in the storage position, a distance between adjacent rails 130 is at least longer than a length of any one of the drivable components 140 retained in one of the adjacent rails 130. However, in some embodiments the second bit storage layer may be used for storage of bits 710 that may be greater than 50% the length of the case (Lc) and, in some cases, greater than 90% of the length of the case (Lc).

Figure 17:
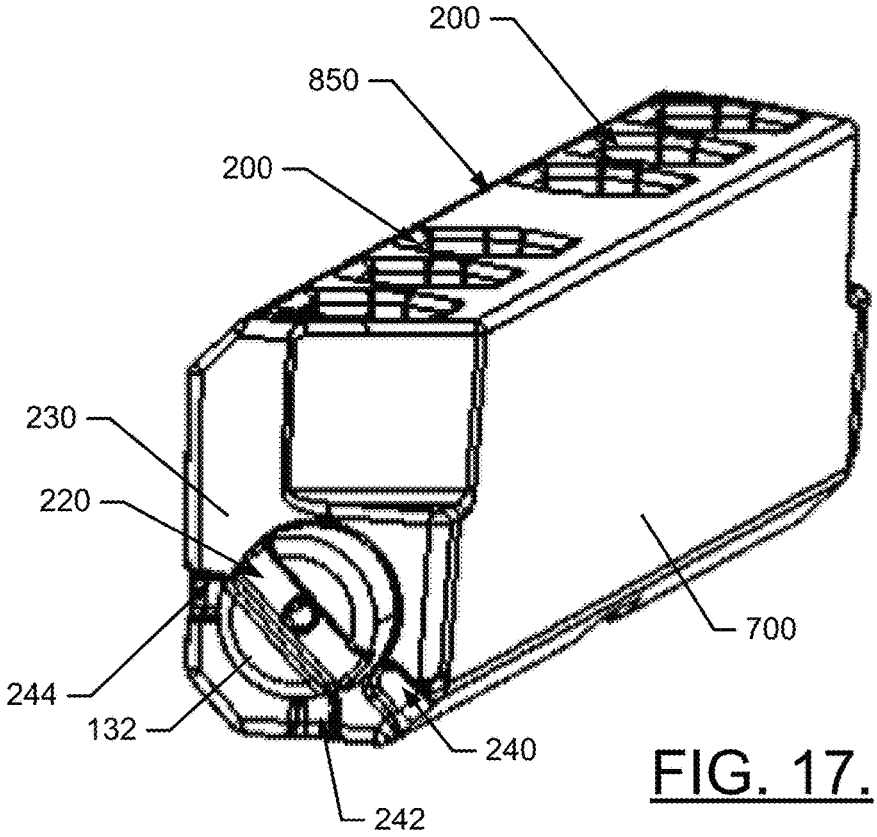
FIG. 17 illustrates a perspective view of an end of the short rail to demonstrate the same interface structures that exist on the long rail.

The modified rails 700 may each have a length that is shorter than the rails 130, and may be supported in the rail holding slots 520 by an adapter assembly. Thus, for example, rails 130 may be referred to as "long rails" and the modified rails 700 may be referred to as "short rails." To accommodate for this difference in lengths, the adapter assembly may include a pair of adapter inserts 720 that are configured to fit in the rail holding slots 520 and modify them. The adapter inserts 720 inserted into each side of a pair of rail holding slots 520 may be identical in structure and therefore interchangeable. The adapter inserts 720 may shorten the length between the rail holding slots 520 to substantially match the length of the modified rails 700. However, the modified rails 700 may otherwise be identical to the rails 130 in terms of their structure relative to interfacing with the case 500. In other words, the modified rails 700 may also include opposing end faces 230 (at opposite ends of a shorter body), and may include a corresponding set of the first, second, and third locking slots 240, 242 and 244 that mirror each other. Similarly, each opposing end of the rail 130 may include an instance of the retention boss 132 described above, and each retention boss 132 may include its own respective instance of the alignment slot 220 formed therein. The retention bosses 132 and alignment slots 220 formed therein may also mirror each other on opposing ends of the modified rail 700. Details of the components that form the interface structure of the modified rail 700 are shown in FIG. 17.

In an example embodiment, when the adapter inserts 720 are inserted into the rail holding slots 520, the rail holding slots 520 (and interface features thereof) may be engaged by or blocked by portions of the adapter inserts 720. However, the adapter inserts 720 may have adapted rail holding slots 730 formed therein. The adapted rail holding slots 730 may be similar in structure and function to the rail holding slots 520 except that the adapted rail holding slots 730 are elevated (to raise bits in the storage position from the first storage plane 600 to the second storage plane 640) and are closer together (e.g., to accommodate the fact that the modified rails 700 are shorter than the rails 130). Thus, the adapted rail holding slots 730 may have a distance therebetween that is about equal to the length of the modified rails 700. Adapted locking protrusions 735 may be provided for each of the adapted rail holding slots 730 similar to the relationship between the locking protrusions 260 and the rail holding slots 520.

As can be appreciated from FIGS. 10, 11, 13 and 14, the first, second and third rails 610, 620 and 630 may be retained in the rail holding slots 520 such that, when rotated to the storage position, the bits 612, 622 and 632 are all disposed at the first bit storage layer in the first storage plane 600. Meanwhile, the adapter inserts 720 (or at least one pair thereof) may be inserted into one set of rail holding slots 520 (in this case the set at the extreme bottom of the case 500) to support only one modified rail 700 at the second bit storage layer in the second storage plane 640. The modified rail 700 and bits 710 may therefore lie over the top of the first, second and third rails 610, 620 and 630 and the bits 612, 622 and 632 such that the modified rail 700 must be rotated to the in-use position prior to any of the first, second or third rails 610, 620 or 630 being enabled to be rotated to the in-use position. However, this also means that any or all of the first, second and third rails 610, 620 and 630 can be rotated to the in-use position while the modified rail 700 is also rotated to the in-use position. Thus, all of the rails can simultaneously be rotated to the exact same degree of rotation.

From the descriptions above, it should be appreciated that the adapter assembly and the adapter inserts 720 effectively move the location of the rail holding slots 520. In particular, the adapted rail holding slots 730 are elevated (from the first storage plane 600 to the second storage plane 640) relative to the rail holding slots 520. As such, the axis of rotation of each of the first, second and third rails 610, 620 and 630 may lie in the first storage plane 600, whereas the axis of rotation of the modified rail 700 may lie in the second storage plane 640.

Referring now to FIG. 18, the structure of the adapter inserts 720 will be described in greater detail. In this regard, for example, the adapter inserts 720 may each include a vertical slot 800 configured to interface with the alignment protrusion 570 of a respective instance of the rail holding slot 520. The adapter inserts 720 may each also include an adapted alignment protrusion 810 in the adapted rail holding slot 730 to interface with opposing ends (and retention boss 132 and the alignment slot 220) of the modified rail 700.

In some cases, the modified rail 700 may include a gap region 850 defining a space in which no receptacles 200 are formed. The lip protrusion 210 of the first, second and third rails 610, 620 and 630 may therefore extend toward the second storage plane 640, and the lip portion 210 may project toward the gap region 850 such that the lip portion 210 is reachable by a user through the second storage plane 640 when the modified rail 700 is in the storage position.

In the examples of FIGS. 10-18, the adapter inserts 720 are used to raise the elevation of the modified rail 700 (e.g., from the first storage plane 600 to the second storage plane 640), but the rail holding slots 520 of the frame member 510 are otherwise all at the same elevation (i.e., the first storage plane 600). In an alternative embodiment, the need for the modified rail 700 and adapter inserts 720 could be obviated by molding at least one elevated rail holding slot 920 into the frame member 910. In such an example, the frame member 910 may include a plurality of slots that are effectively identical to the rail holding slots 520 discussed above. All of these rail holding slots 520 may be configured to hold a rail 130 at the first storage plane 600. However, at least one slot (i.e., the elevated rail holding slot 920) may be elevated such that when the rail 130 is inserted therein, the corresponding bits stored in the rail 130 would be retained at the second storage plane 640 when in the storage position.

Accordingly, some example embodiments may provide a case for storing drivable components. The case may include a first half shell and a second half shell operably coupled to each other via a hinge, a frame member included in at least one of the first half shell or the second half shell, a first rail having a first length and including a first plurality of receptacles configured to receive a first set of drivable components, and a second rail having a second length shorter than the first length and including a second plurality of receptacles configured to receive a second set of drivable components. The frame member may include rail holding slots disposed in lateral sides of the frame member. Both the first rail and the second rail may be configured to be removable from the rail holding slots and rotatable in the rail holding slots between a storage position in which the first rail or the second rail is fixed in an orientation in which the first and second sets of drivable components extend substantially parallel to a base portion forming an outer wall of the case and an in-use position in which the first rail or the second rail is rotated out of the storage position. When in the storage position, the first rail may be retained at a first bit storage layer within the case and the second rail is retained at a second bit storage layer. Additionally, or as an alternative to the provision of the first and second storage layers, the first rail may be configured to pivot about a first rail axis, and the second rail may be configured to pivot about a second rail axis that is substantially parallel to the first rail axis. Both the first rail and the second rail axes may also substantially perpendicular to a hinge axis of the hinge.

The case and/or components thereof described above may be augmented or modified by altering individual features mentioned above or adding optional features. The augmentations or modifications may be performed in any combination and in any order. For example, in some cases, the first bit storage layer may lie in a first plane substantially parallel to the base portion, and the second bit storage layer may lie in a second plane substantially parallel to the base portion and spaced farther apart from the base portion than the first plane. In an example embodiment, a distance between a pair of the rail holding slots positioned opposite each other in the lateral sides of the frame member may be about equal to the first length, and the case may further include an adapter assembly configured to interface with the pair of rail holding slots to define a pair of adapted rail holding slots having a distance therebetween that is about equal to the second length. In some cases, at least some of the second set of drivable components may include a quarter-inch hex shaft and have a length greater than 50% of a length of the case, and at least some of the first set of drivable components may have a length less than 50% of the length of the case. In an example embodiment, multiple instances of the first rail may be disposed at the first bit storage layer, and only one instance of the second rail may be disposed at the second bit storage layer. The second rail may be configured such that the second rail must be rotated to the in-use position prior to any of the multiple instances of the first rail being enabled to be rotated to the in-use position. In some cases, the adapter assembly may elevate the pair of adapted rail holding slots such that the second rail, when installed in the adapter assembly, is elevated relative to the base portion to the second bit storage level. In an example embodiment, the adapter assembly may include a first adapter insert and a second adapter insert, and the first and second adapter inserts may each have an identical structure and be insertable into respective opposing rail holding slots of the pair of rail holding slots. In some cases, each rail holding slot may include an alignment protrusion, the first and second adapter inserts may each include a vertical slot configured to interface with the alignment protrusion of a respective instance of the rail holding slot, and the first and second adapter inserts may each include an adapted alignment protrusion in the adapted rail holding slot to interface with opposing ends of the second rail. In an example embodiment, the second rail may include a gap region defining a space in which no receptacles are formed. The first rail comprises a lip protrusion that extends toward the second plane, and wherein the lip protrusion projects toward the gap region such that the extension portion is reachable by a user through the second plane when the second rail is in the storage position.

In another example embodiment, a case for storing drivable components may include a first half shell and a second half shell operably coupled to each other via a hinge, where the first half shell defines an opening 506 and a first planar surface 508 coexistent with the opening 506. The case may also include a frame member included in the first half shell and a plurality of rails. The frame member may include rail holding slots disposed in lateral sides of the frame member. The plurality of rails may each include a plurality of receptacles configured to receive drivable components. Each of the plurality of rails may be configured to pivot about a respective rail axis. The rails may be configured to be removable from the rail holding slots and rotatable in the rail holding slots between a storage position in which the first rail or the second rail is fixed in an orientation in which the drivable components extend substantially parallel to the first planar surface 508 and an in-use position in which the first rail or the second rail is rotated out of the storage position. The rail holding slots may include a first set of rail holding slots configured to retain one or more instances of the rails in the first set of rail holding slots at a first bit storage layer within the case and at least one elevated rail holding slot configured to retain another instance of the rails at a second bit storage layer. The first bit storage layer may be parallel to and a first distance from the first planar surface 508 and the second bit storage layer being parallel to and a second distance from the first planar surface 508. The first distance may not be equal to the second distance. In some cases, the at least one elevated rail holding slot may be proximate to only a single slot of the first set of rail holding slots.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A case for storing drivable components, the case comprising:

a first half shell and a second half shell operably coupled to each other via a hinge;

a frame member included in at least one of the first half shell or the second half shell;

a first rail comprising a first plurality of receptacles configured to receive a first set of drivable components, the first rail having a first length; and a modified rail comprising a second plurality of receptacles configured to receive a second set of drivable components, the modified rail having a second length that is shorter than the first length, wherein the first length is measured at a longest dimension of the first rail and the second length is measured at a longest dimension of the modified rail, wherein the frame member comprises rail holding slots disposed in lateral sides of the frame member, wherein both the first rail and the modified rail are configured to be removable from the rail holding slots and rotatable in the rail holding slots between a storage position in which the first rail or the modified rail is fixed in an orientation in which the first and second sets of drivable components extend substantially parallel to a base portion forming an outer wall of the case and an in-use position in which the first rail or the modified rail is rotated out of the storage position, wherein, when in the storage position, the first rail is retained at a first bit storage layer within the case and the modified rail is retained at a second bit storage layer, wherein the first bit storage layer lies in a first plane substantially parallel to the base portion, wherein the second bit storage layer lies in a second plane substantially parallel to the base portion and spaced farther apart from the base portion than the first plane, wherein a distance between a pair of the rail holding slots positioned opposite each other in the lateral sides of the frame member is about equal to the first length, and wherein the case further comprises an adapter assembly configured to interface with the pair of rail holding slots to define a pair of adapted rail holding slots having a distance therebetween that is about equal to the second length.

2. The case of claim 1, wherein the hinge defines a hinge axis, wherein the first rail rotates about a first rail axis, and the modified rail rotates about a second rail axis that is substantially parallel to the first rail axis, and wherein the first and second rail axes are substantially perpendicular to the hinge axis.

3. The case of claim 1, wherein at least some of the second set of drivable components include a quarter-inch hex shaft and have a length greater than 50% of a length of the case, and wherein at least some of the first set of drivable components include a quarter-inch hex shaft and have a length less than 50% of the length of the case.

4. The case of claim 3, wherein multiple instances of the first rail are disposed at the first bit storage layer, and only one instance of the modified rail is disposed at the second bit storage layer, and wherein the modified rail must be rotated to the in-use position prior to any of the multiple instances of the first rail being enabled to be rotated to the in-use position.

5. The case of claim 1, wherein the adapter assembly elevates the pair of adapted rail holding slots such that the modified rail, when installed in the adapter assembly, is elevated relative to the base portion to the second bit storage level.

6. The case of claim 5, wherein the adapter assembly comprises a first adapter insert and a second adapter insert, the first and second adapter inserts each having an identical structure and being insertable into respective opposing rail holding slots of the pair of rail holding slots.

7. The case of claim 6, wherein each rail holding slot comprises an alignment protrusion, wherein the first and second adapter inserts each include a vertical slot configured to interface with the alignment protrusion of a respective instance of the rail holding slot, and wherein the first and second adapter inserts each include an adapted alignment protrusion in the adapted rail holding slot to interface with opposing ends of the modified rail.

8. The case of claim 1, wherein the modified rail comprises a gap region defining a space in which no receptacles are formed, wherein the first rail comprises a lip portion that extends toward the second plane, and wherein the lip portion projects toward the gap region such that the lip portion is reachable by a user through the second plane when the modified rail is in the storage position.

9. A case for storing drivable components, the case comprising:

a first half shell and a second half shell operably coupled to each other via a hinge, the first half shell defining an opening and a first planar surface coexistent with the opening;

a frame member included in the first half shell, the frame member comprising rail holding slots disposed in lateral sides of the frame member; and a plurality of rails each comprising a plurality of receptacles configured to receive drivable components, each of the plurality of rails being configured to pivot about a respective rail axis; and wherein the rails are configured to be removable from the rail holding slots and rotatable in the rail holding slots between a storage position in which the rails are fixed in an orientation in which the drivable components extend substantially parallel to the first planar surface and an in-use position in which the rails are rotated out of the storage position, and wherein the rail holding slots comprise a first set of rail holding slots configured to retain one or more instances of the rails in the first set of rail holding slots at a first bit storage layer within the case and at least one elevated rail holding slot configured to retain another instance of the rails at a second bit storage layer, the first bit storage layer being parallel to and a first distance from the first planar surface and the second bit storage layer being parallel to and a second distance from the first planar surface, the first distance not being equal to the second distance.

10. The case of claim 9, wherein the frame member is integrally formed in the first half shell or the second half shell.

11. The case of claim 10, wherein the at least one elevated rail holding slot is proximate to only a single slot of the first set of rail holding slots.

12. The case of claim 11, wherein a distance between each pair of the first rail holding slots and the elevated rail holding slot is the same.

13. The case of claim 12, wherein at least some of a second set of drivable components stored in the other instance of the rails at the second bit storage layer include a quarter-inch hex shaft and have a length greater than 50% of a length of the case, and wherein at least some of a first set of drivable components stored at the first bit storage layer include a quarter-inch hex shaft and have a length less than 50% of the length of the case.

14. The case of claim 13, wherein multiple instances of the rails are disposed at the first bit storage layer, and only one instance of the rails is disposed at the second bit storage layer, and wherein the only one instance of the rails that is disposed at the second bit storage layer must be rotated to the in-use position prior to any of the rails disposed at the first bit storage layer are enabled to be rotated to the in-use position.

15. A case for storing drivable components, the case comprising:

a frame member comprising rail holding slots disposed in pairs on opposing lateral sides of the frame member, each rail holding slot comprising an alignment protrusion;

a plurality of first rails configured to receive and retain respective ones of the drivable components;

a single second rail configured to receive and retain other respective ones of the drivable components; and an adapter assembly configured to interface with a single pair of rail holding slots to define an adapted pair of rail slots, the adapted pair of rail slots being configured to interface with the second rail, wherein the first rails each comprise a first body having a first length extending between one pair of rail holding slots, and a retention boss at each opposing end of the first body, wherein the second rail comprises a second body having a second length extending between the adapted pair of rail slots, and respective instances of the retention boss at each opposing end of the second body, and wherein the retention boss includes an alignment slot formed therein, and wherein the first and second rails are removable from or insertable into the rail holding slots and adapted rail holding slots, respectively, based on alignment of the alignment slot and the alignment protrusion.

16. The case of claim 15, wherein the adapter assembly elevates the adapted pair of rail holding slots such that the second rail, when installed in the adapter assembly, is elevated relative to the base portion to a higher level than a level of the first rail holding slots.

17. The case of claim 16, wherein the adapter assembly comprises a first adapter insert and a second adapter insert, the first and second adapter inserts each having an identical structure and being insertable into respective opposing rail holding slots of the single pair of rail holding slots.

18. The case of claim 17, wherein the first rails rotate about a first rail axis, and the second rail rotates about a second rail axis that is substantially parallel to the first rail axis, and wherein the first and second rail axes are substantially perpendicular to a hinge axis of the case.

* * * * *